US008778588B2

(12) United States Patent
Kusahara et al.

(10) Patent No.: US 8,778,588 B2
(45) Date of Patent: Jul. 15, 2014

(54) TONER FOR ELECTROSTATIC CHARGE DEVELOPMENT

(75) Inventors: Teruki Kusahara, Shizuoka (JP); Junichi Awamura, Shizuoka (JP); Tsuyoshi Sugimoto, Shizuoka (JP); Hyo Shu, Kanagawa (JP); Tomomi Suzuki, Shizuoka (JP); Osamu Uchinokura, Shizuoka (JP); Takahiro Honda, Shizuoka (JP); Satoshi Kojima, Shizuoka (JP); Satoshi Ogawa, Nara (JP); Daisuke Inoue, Shizuoka (JP); Koshi Sato, Miyagi (JP); Daisuke Ito, Shizuoka (JP); Ryuuta Yoshida, Miyagi (JP); Syouko Satoh, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 107 days.

(21) Appl. No.: 13/637,774

(22) PCT Filed: Oct. 12, 2011

(86) PCT No.: PCT/JP2011/073449

§ 371 (c)(1),
(2), (4) Date: Sep. 27, 2012

(87) PCT Pub. No.: WO2012/101875

PCT Pub. Date: Aug. 2, 2012

(65) Prior Publication Data

US 2013/0022371 A1 Jan. 24, 2013

(30) Foreign Application Priority Data

Jan. 27, 2011 (JP) ..... 2011-014780

(51) Int. Cl.
*G03G 9/08* (2006.01)
*G03G 9/087* (2006.01)

(52) U.S. Cl.
CPC ..... *G03G 9/0821* (2013.01); *G03G 9/08755* (2013.01); *G03G 9/08797* (2013.01)
USPC ..... 430/111.4; 430/109.4; 399/252

(58) Field of Classification Search
CPC ..... G03G 9/0821
USPC ..... 430/109.4, 111.4
See application file for complete search history.

(56) References Cited

U.S. PATENT DOCUMENTS 7,459,255 B2 12/2008 Tanaka et al.
2001/0018157 A1 8/2001 Aoki et al.

(Continued)

FOREIGN PATENT DOCUMENTS

JP 02-157765 6/1990
JP 2896826 3/1999

(Continued)

OTHER PUBLICATIONS

International Search Report Issued Dec. 20, 2011 in International Patent Application No. PCT/JP2011/073449 Filed Oct. 12, 2011.

*Primary Examiner* — Mark A Chapman
(74) *Attorney, Agent, or Firm* — Oblon, Spivak, McClelland, Maier & Neustadt, L.L.P.

(57) ABSTRACT

To provide a toner, which contains a binder resin, a colorant, and a releasing agent, wherein the binder resin contains a low molecular weight resin component, where the low molecular weight resin component has a resin softening coefficient (A), represented by the following formula (1), satisfying A>0.165, and has storage elastic modulus (dyne/cm$^2$) G'(Tfb) satisfying G'(Tfb)≤1×10$^4$ where Tfb is a flow onset temperature (° C.) of the low molecular weight resin component as measured by a capillary rheometer:

$$A=|[(r1)-\ln G'(r2)]/(T1-T2)| \quad \text{Formula (1)}$$

(where T1 is temperature (° C.) at which storage elastic modulus G'(r1) is 1×10$^5$ (dyne/cm$^2$) and T2 is temperature (° C.) at which storage elastic modulus G'(r2) is 1×10$^3$ (dyne/cm$^2$) as measured by means of a viscoelasticity measuring device with measuring frequency of 1 Hz, and measuring distortion of 1 deg; and | | represents an absolute value.).

17 Claims, 3 Drawing Sheets

(56) References Cited

U.S. PATENT DOCUMENTS

| | | | |
|---|---|---|---|
| 2004/0142264 | A1 | 7/2004 | Tanaka et al. |
| 2005/0042534 | A1 | 2/2005 | Tanaka et al. |
| 2006/0057488 | A1 | 3/2006 | Inoue et al. |
| 2006/0063089 | A1 | 3/2006 | Tanaka et al. |
| 2006/0068312 | A1 | 3/2006 | Yamashita et al. |
| 2007/0020551 | A1 | 1/2007 | Sasaki et al. |
| 2010/0129748 | A1 | 5/2010 | Inoue et al. |
| 2011/0076612 | A1 | 3/2011 | Awamura et al. |
| 2011/0129773 | A1 | 6/2011 | Shu et al. |
| 2011/0223532 | A1 | 9/2011 | Sugimoto et al. |
| 2011/0262856 | A1 | 10/2011 | Sugimoto et al. |

FOREIGN PATENT DOCUMENTS

| | | |
|---|---|---|
| JP | 11-249339 | 9/1999 |
| JP | 2001-222138 | 8/2001 |
| JP | 2003-302791 | 10/2003 |
| JP | 2004-191516 | 7/2004 |
| JP | 2004-206081 | 7/2004 |
| JP | 2004-302458 | 10/2004 |
| JP | 2005-107387 | 4/2005 |
| JP | 2005-338814 | 12/2005 |
| JP | 2006-084743 | 3/2006 |
| JP | 2006-085095 | 3/2006 |
| JP | 2006-119617 | 5/2006 |
| JP | 2006-178407 | 7/2006 |
| JP | 2006-276308 | 10/2006 |
| JP | 3885241 | 12/2006 |
| JP | 2007-025449 | 2/2007 |
| JP | 2007-033900 | 2/2007 |
| JP | 2007-279652 | 10/2007 |
| JP | 2008-158319 | 7/2008 |
| JP | 2009-069862 | 4/2009 |
| JP | 2009-093049 | 4/2009 |
| JP | 2011-203717 | 10/2011 |

TONER FOR ELECTROSTATIC CHARGE DEVELOPMENT

TECHNICAL FIELD

The present invention relates to a toner for developing an electrostatic image, a toner container that houses the toner and is capable of reducing an inner volume thereof, and an image forming apparatus equipped with the toner container.

BACKGROUND ART

Currently, photocopiers have been required to be able to copy an image on a large number of sheets at high speed with small size thereof, while maintaining high image quality. Conventional high-speed photocopiers however have not necessarily achieved downsizing. One of the reasons for this is a space required for residual toner collected after transferring. Meanwhile, a treatment of the residual toner collected after transferring is very serious issue in view of current environmental problems. Namely, the aforementioned problems can be solved, and a small and high speed photocopier without causing environmental problems can be achieved by supplying the residual toner collected after transferring to a developing unit. As a result of the supplement of the toner, a number of sheets on which copying can be performed increases, cost per one operation of copying reduces, and therefore the entire process becomes economical.

In the past, there has been an attempt to use the residual toner collected after transferring in a developing step by supplying the residual toner to a developing unit. However, various problems occur when this step is introduced, such as deterioration of images, and reduction in image density, as copying on a large number of sheets is repeatedly performed, and therefore there is a problem that it is difficult to stably provide images over a long period.

PTL 1 discloses a developer that intends to solve the aforementioned problems by regulating a particle size distribution of a toner.

Specifically, the developer uses toner particles where 90% by mass or greater of the whole toner particles is in the range of $D(3\sqrt{2})-1$ to $3\sqrt{2}D$, and a proportion of the toner particles smaller than $D(3\sqrt{2})-1$ is 5% by mass or smaller, when the volume average particle diameter of the toner is D (μm).

However, application of this technique is limited to a two-component developing method. Since a proportion of extremely small particles is kept low, there are advantages that defects such as fogging and toner scattering are prevented at the time of recycling, but on the other hand, accurate copy of a precise latent image cannot be produced as the proportion of the small particles is extremely low.

Moreover, PTL 2 discloses a toner having a certain particle size distribution, but which has not yet achieved prevention of carrier spent, or fogging caused by the recycled toner.

Meanwhile, in the course of image formation by electrophotography, a toner is fixed onto an image support by a thermal fixing method to obtain a permanent visible copy image.

In the case where a copy image is formed on a transparent sheet for an overhead projector (OHP), such sheet may be referred to as an "OHP sheet" hereinafter, with a toner, especially a color toner, it is required to fix an image to give a smooth image surface to thereby prevent scattering of transmitting light, or diffused reflection on the image surface at the time of projecting, for the purpose of attaining excellent light transmittance of a projected image by the OHP.

To this end, as a common conventional method, used is a color toner, which has low viscoelasticity at a melting point thereof compared to a conventional black toner, and can be rapidly transferred into a melted state, so that an image surface is easily smoothed by heating and pressurizing.

However, making viscoelastic properties of the toner low in the aforementioned manner also lowers the glass transition temperature of the toner at the same time, and therefore, the dynamic strength of the toner lowers at ambient temperature, specifically when the toner is used in a device. Accordingly, a problem that an external additive on a surface of a toner particle is embedded to thereby deteriorate developing properties and transferring properties occurs, for example, by application of physical stress, such as stirring, within a developing unit.

Moreover, toner spent, which is deposition of toner particles on carrier particles, occurs.

These problems are significantly caused when toner particles are made small for achieving high quality images to meet current needs. This is because the toner tends to receive physical stress more easily as particle diameters of the toner particles become smaller.

To solve the aforementioned problem, in PTL 3, a toner, which has a certain relationship between the volume average particle diameter Dv (μm) and storage elastic modulus G'170 (dyne/cm$^2$) at 170° C., is used to improve transparency with an OHP. On theory, such toner increases its storage elastic modulus as the average particle diameter of the toner decreases. When the average particle diameter of the toner is small, it is disadvantageous in achieving low temperature fixing ability and desirable glossiness of the toner. As a result, color reproducibility may be lowered. Namely, it is not easy to achieve all of the current needs, which are a toner of small particle diameters, high image quality, low temperature fixing ability, and color reproducibility.

As measure for improving low temperature fixing ability of a toner, PTL 4 discloses a binder resin for a toner, which contains non-crystalline polyester, and crystalline polyester that has a significant effect for improving low temperature fixing ability, compared to conventional non-crystalline polyester. In the case where the crystalline polyester and the non-crystalline polyester are used in combination, however, transesterification occurs during a melt-kneading process because compositions of the both resins are similar. Therefore, high crystallinity of the ctystalline polyester cannot be maintained, leading to low shelf stability of a resulting toner.

PTL 5 and PTL 6 each disclose a binder resin for a toner, which contains crystalline polyester using sebasic acid or adipic acid as a carboxylic acid component, and a styrene-acryl resin, and evaluate shelf stability under low temperature, and fixing ability at low printing speed. However, further improvements of their performances are desired.

PTL 7 discloses a binder resin for a toner, which contains certain crystalline polyester, and a non-crystalline hybrid resin, and discloses that a toner having a wide fixable temperature range and durability can be provided. However, it has not solved fogging and uneven image density caused by poor compatibility between the crystalline polyester and a pigment.

PTL 8 discloses use of crystalline polyester, as a binder resin, to achieve low temperature fixing ability, where the crystalline polyester resin contains the structure represented by —OCOC—R—COO—$(CH_2)_n$— (with proviso that R is a C2-C20 linear-chain unsaturated aliphatic group, and n is an integer of 2 to 20) in an amount of 60 mol % relative to the total ester bonds in the entire resin, but it has not discussed about improvement of shelf stability.

Meanwhile, it is proposed that a toner container is composed of a flexible material and as well as the toner, the toner container is also made compact, such as by folding, after use for collection, in view of environmental concern. Such container has a large rate of volume reduction, and can be achieved at low cost. Moreover, such container can automatically supply a toner by air after loaded in a main body of a device so that a toner is not flown in the air.

Such container, however, has problems including (1) toner supply is not stable; (2) there are cases where a toner cannot be supplied because the toner is packed in the container after a period of storage; and (3) a residual amount of the toner is large. These are caused because a spiral groove for supplying a toner cannot be formed in the container, a member for supplying a toner, such as an agitator, cannot be incorporated into the container, etc.

CITATION LIST

Patent Literature

PTL 1 Japanese Patent Application Laid-Open (JP-A) No. 02-157765
PTL 2 Japanese Patent (JP-B) No. 2896826
PTL 3 JP-B No. 3885241
PTL 4 JP-A No. 2001-222138
PTL 5 JP-A No. 11-249339
PTL 6 JP-A No. 2003-302791
PTL 7 JP-A No. 2004-191516
PTL 8 JP-A No. 2005-338814

SUMMARY OF INVENTION

Technical Problem

The present invention aims to provide a toner for developing a latent electrostatic image, having a small particle diameter, and ensuring all of high image quality, desirable cleaning property, high coloring ability, low temperature fixing ability, and shelf stability even in use for a recycling system. In addition, the present invention aims to provide a toner for developing a latent electrostatic image, which is used as a color toner, and ensures all of high image quality, low temperature fixing ability, shelf stability, and high coloring ability.

Further, the present invention aims to provide a toner container and an image forming apparatus equipped with the toner container, in which a toner is stably automatically supplied to a developing unit from a the toner container that can be collect compactly after use, as the toner container is formed of a flexible material, and packing of the toner powder does not occur in the container after a storage period, and moreover, a residual amount of the toner powder in the container can be reduced.

Solution to Problem

The means for solving the aforementioned problems are as follows:

<1> A toner containing:
a binder resin;
a colorant; and
a releasing agent,
wherein the binder resin contains a low molecular weight resin component, where the low molecular weight resin component has a resin softening coefficient (A), represented by the following formula (1), satisfying A>0.165, and has storage elastic modulus (dyne/cm$^2$) G'(Tfb) satisfying G'(Tfb) $\leq 1\times10^4$ where Tfb is a flow onset temperature (° C.) of the low molecular weight resin component as measured by a capillary rheometer:

$$A=|[\ln G'(r1)-\ln G'(r2)]/(T1-T2)| \quad \text{Formula (1)}$$

(where T1 is temperature (° C.) at which storage elastic modulus G'(r1) is $1\times10^5$ (dyne/cm$^2$) and T2 is temperature (° C.) at which storage elastic modulus G'(r2) is $1\times10^3$ (dyne/cm$^2$) as measured by means of a viscoelasticity measuring device with measuring frequency of 1 Hz, and measuring distortion of 1 deg; and || represents an absolute value.)

<2> The toner according to <1>, wherein the low molecular weight resin component is low molecular weight polyester.

<3> The toner according to <2>, wherein the low molecular weight polyester has a weight average molecular weight of 2,000 to 10,000.

<4> The toner according to any of <2> or <3>, wherein the low molecular weight polyester has an acid value of 1.0 mgKOH to 50.0 mgKOH/g.

<5> The toner according to any one of <2> to <4>, wherein the low molecular weight polyester has glass transition temperature of 35° C. to 65° C.

<6> The toner according to any one of <1> to <5>, wherein the binder resin further contains a crystalline polyester resin containing a polyhydric alcohol component and a carboxylic acid component.

<7> The toner according to <6>, wherein the crystalline polyester resin contains an aromatic component in an amount that is larger than an amount of an aromatic component contained in the low molecular weight polyester.

<8> The toner according to any of <6> or <7>, wherein a mass ratio of the low molecular weight polyester to the crystalline polyester, which is represented by (low molecular weight polyester/crystalline polyester), is 1.5 to 2.

<9> The toner according to any one of <6> to <8>, wherein the binder resin satisfies a relationship represented by the following formula (2):

$$1.80\geq|SP(b)-SP(a)|\geq1.05 \quad \text{Formula (2)}$$

where SP(a) is a solubility parameter (SP) value of the crystalline polyester, and SP(b) is a solubility parameter (SP) value of the low molecular weight polyester.

<10> The toner according to any one of <1> to <9>, wherein the toner is obtained by granulating from a dispersion liquid in which an oil phase is dispersed in an aqueous phase, where the oil phase contains at least a binder resin and/or a binder resin precursor, a colorant, and a releasing agent in an organic solvent.

<11> The toner according to <10>, wherein the aqueous medium contains either layered inorganic mineral in which at least part of ions present between layers of the layered inorganic mineral is modified with organic ions, or organic resin particles.

<12> The toner according to any of <10> or <11>, wherein the binder resin precursor contains a modified polyester resin.

<13> The toner according to any one of <1> to <12>, wherein the toner has an average circularity of 0.94 to 0.99.

<14> The toner according to any one of <1> to <13>, wherein the toner has a volume average particle diameter of 3 μm to 7 μm.

<15> The toner according to any one of <1> to <14>, wherein the toner has Dv/Dn of 1.30 or lower, where Dv is a volume average particle diameter of the toner and Dn is a number average particle diameter of the toner.

<16> The toner according to any one of <1> to <15>, wherein a proportion of particles of the toner having diameters of 2 μm or smaller is 1% by number to 20% by number.

<17> A two-component developer containing the toner as defined in any one of <1> to <16>, and a carrier.

<18> A toner container, containing a flexible member capable of reducing an inner volume thereof by 60% or greater, and the toner as defined in any one of <1> to <16> housed in the flexible member.

<19> An image forming apparatus, containing:

an image bearing member;

an electrostatic image forming unit configured to form an electrostatic image on the image bearing member; and a developing unit configured to develop the electrostatic image with a toner to form a visible image, wherein the developing unit is equipped with a toner supplying device, where the toner supplying device contains:

a toner container housing the toner;

an air inflow unit configured to flow air into the toner container;

a pump unit configured to supply the toner as a fluid with the flown air; and a toner feeding tube configured to feed the toner from the cartridge to the developing unit, wherein the toner container is the toner container as defined in <18>.

Advantageous Effects of Invention

The present invention can provide a toner for developing a latent electrostatic image, having a small particle diameter, and ensuring all of high image quality, desirable cleaning property, high coloring ability, low temperature fixing ability, and shelf stability even in use for a recycling system, and moreover, the present invention can provide a toner for developing a latent electrostatic image that is a color toner and has high image quality, low temperature fixing ability, high transparency on OHP, and high coloring ability.

DESCRIPTION OF EMBODIMENTS

Figure 1:
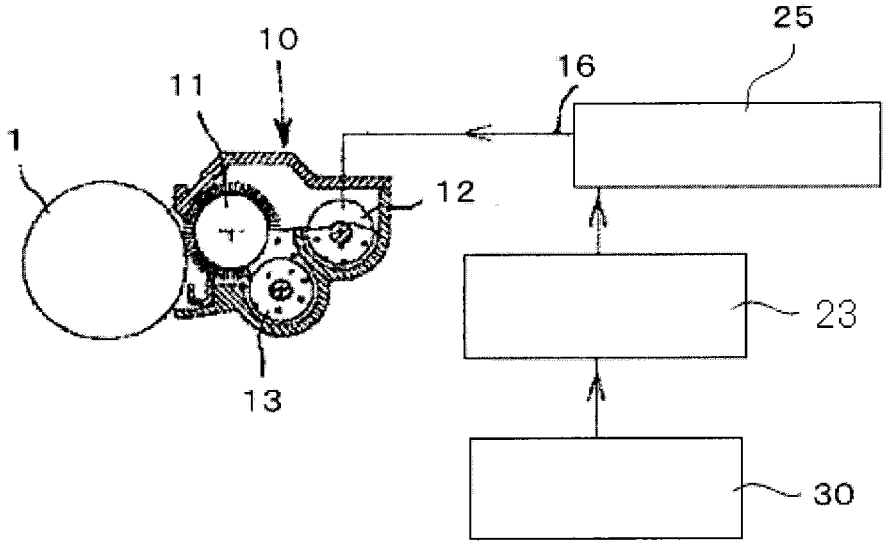
FIG. 1 is an explanatory diagram illustrating a method for supplying a toner from a toner container to a developing unit.

A toner container housing the toner and capable of reducing its volume, and an image forming apparatus equipped with the toner container carrier will be specifically explained hereinafter.

In order to attain a toner which is desirably supplied, does not cause deposition of particles thereof to carrier particles, so-called toner spent, has excellent shelf stability and fixing ability, and has high glossiness, it is necessary that a toner is not softened in each process performed prior to a fixing process, namely toner feeding, supplying, developing, and transferring, and that the toner is instantly melted and fixed upon application of thermal energy during fixing. To this end, a toner needs to have certain rheological properties. As a results of the researches diligently conducted by the present inventors, it has been found that a toner can ensures both low temperature fixing ability and shelf stability, as well as high coloring ability, when a binder resin contained in the toner contains a low molecular weight resin component whose resin softening coefficient (A) is larger than 0.165 (A>0.165), and G'(Tfb) is $1\times10^4$ or smaller (G'(Tfb)≤$1\times10^4$).

Accordingly, the present invention is directed to a toner containing a binder resin, a colorant, and a releasing agent, where the binder resin contains a low molecular weight resin component whose resin softening coefficient (A) represented by the following formula (1) is A>0.165, and whose storage elastic modulus (dyne/cm$^2$) G'(Tfb), in which Tfb is flow onset temperature (° C.) as measured by a capillary rheometer, is G'(Tfb)≤$1\times10^4$. As a result, a difference between softening temperature and flow onset temperature of the toner is small, namely rubber plateau is narrow. Therefore, a transition from a solid state to a flow region is quickly performed, and sharp-melt properties of a toner during fixing are improved to achieve excellent low temperature fixing ability of the toner, as well as ensuring heat resistant storage stability.

$$A=|[\ln G'(r1)-\ln G'(r2)]/(T1-T2)| \quad \text{Formula (1)}$$

(with proviso that, T1 is temperature (° C.) at which the storage elastic modulus G'(r1) becomes $1\times10^5$ (dyne/cm$^2$) and T2 is temperature (° C.) at which storage elastic modulus G'(r2) becomes $1\times10^3$, as measured by means of a viscoelasticity measuring device with a measuring frequency of 1 Hz, and measuring strain of 1 deg, and || represents an absolute value.)

Note that the low molecular weight resin component is a component of the binder resin, and has a molecular weight of 1,000 or greater, but smaller than 10,000.

The flow onset temperature Tfb measured by a capillary rheometer is temperature at which a resin starts flowing after passing rubber plateau in rheological behaviors of the resin, and G'(Tfb) is storage elastic modulus at the flow onset temperature Tfb. The storage elastic modulus G'(Tfb) at the flow onset temperature can be adjusted by a formulating ratio of resin components added to the resin.

Moreover, the resin softening coefficient (A) is an index for indicating a change in the storage elastic modulus corresponding to a temperature change around the flow onset temperature. The large resin softening coefficient (A) indicates that the storage modulus largely changes around the flow onset temperature, which indicates sharp melting.

Since the low molecular weight resin component is a group of molecules having various molecular weights and molecular structures, all of the molecules do not flow at the same time, but flow starts partially. Therefore, the resin softening coefficient (A) of the low molecular weight resin component can be made larger than 0.165, for example, by unifying the molecular weights and molecular structures of the molecules thereof.

It is preferred that the molecular weights and molecular structures of molecules of the low molecular weight resin component be unified by allowing the molecules to react slowly over a long period, reducing pressure of the reaction system in the latter half of a polyaddition reaction of a bivalent monomer to accelerate the reaction, followed by adding and reacting a trivalent or higher monomer.

The number average molecular weight of the low molecular weight resin component is preferably 1,200 to 4,000, and the weight average molecular weight of the low molecular weight resin component is preferably 2,000 to 10,000, more preferably 2,200 to 7,000. A molecular weight distribution (Mw/Mn) represented by a ratio of the weight average molecular weight (Mw) to the number average molecular weight (Mn) is preferably 1.1 to 3.

The low molecular weight resin component is preferably low molecular weight polyester, and is obtained by using monomers containing an alcohol component composed of a bihydric or higher polyhydric alcohol, and a carboxylic acid component composed of a bivalent or higher polyvalent carboxylic acid. As for the alcohol component and carboxylic acid component of the low molecular weight polyester, those used for the crystalline polyester resin, which will be described later, can be used, excluding an amount of each component. However, the alcohol component preferably contains esterified diphenol represented by the following general formula (1), more preferably contains esterified diphenol represented by the following general formula (1) where R is $C_2H_4$, x and y are each 1, in an amount of 50% by mass or greater.

General Formula (1)

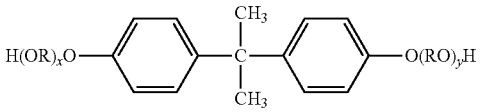

In the general formula (1), R is a C2-C3 alkylene group, x and y are each an integer of 1 to 10.

The glass transition temperature Tg of the low molecular weight polyester is preferably 35° C. to 65° C., more preferably 40° C. to 50° C.

The acid value of the low molecular weight polyester is preferably 1.0 mgKOH/g to 50.0 mgKOH/g, more preferably 5 mgKOH/g to 25 mgKOH/g, and even more preferably 10 mgKOH/g to 25 mgKOH/g.

The hydroxyl value of the low molecular weight polyester is preferably 5 mgKOH/g or greater, more preferably 10 mgKOH/g to 120 mgKOH/g, and even more preferably 20 mgKOH/g to 80 mgKOH/g. When the hydroxyl value is less than 5 mgKOH/g, it may not be desirable as both heat resistant storage stability and low temperature fixing ability are not achieved.

A measuring method of storage elastic modulus G' and that of flow onset temperature of the low molecular component of the binder resin of the toner will be explained hereinafter.

<Measuring Method of Storage Elastic Modulus G'>

The measurement of the storage elastic modulus G' is performed, for example, by means of a viscoelasticity measuring device (rheometer) RDA-II (of TA Instruments Japan Inc. (previously Rheometric Scientific)).

Fixture: A parallel plate having a diameter of 7.9 mm is used.

Measuring sample: After heating and melting the toner, the melted toner is poured into a mold to thereby form a cylindrical sample having a diameter of about 8 mm, and height of 3 mm. The thus produced sample is used.

Measuring frequency: 1 Hz

Measuring temperature: 50° C. to 230° C.

Setting of measuring distortion: An initial value was set to 0.1%, and a measurement is carried out in an automatic measuring mode.

Correction of elongation of sample: It is adjusted in an automatic measuring mode.

<Measuring Method of Tfb>

The measurements of Ts and Tfb are carried out by means of capillary rheometer (manufactured by Shimadzu Corporation) in accordance with the method described in JIS K72101.

A load of 10 kg/cm$^2$ is applied to a sample in the size of 1 cm$^3$ with a plunger with heating the sample at heating rate of 6° C./min, to thereby push the sample through a nozzle having a diameter of 0.5 mm, and a length of 1 mm, from which a plunger fall-temperature curve is drawn.

Figure 5:
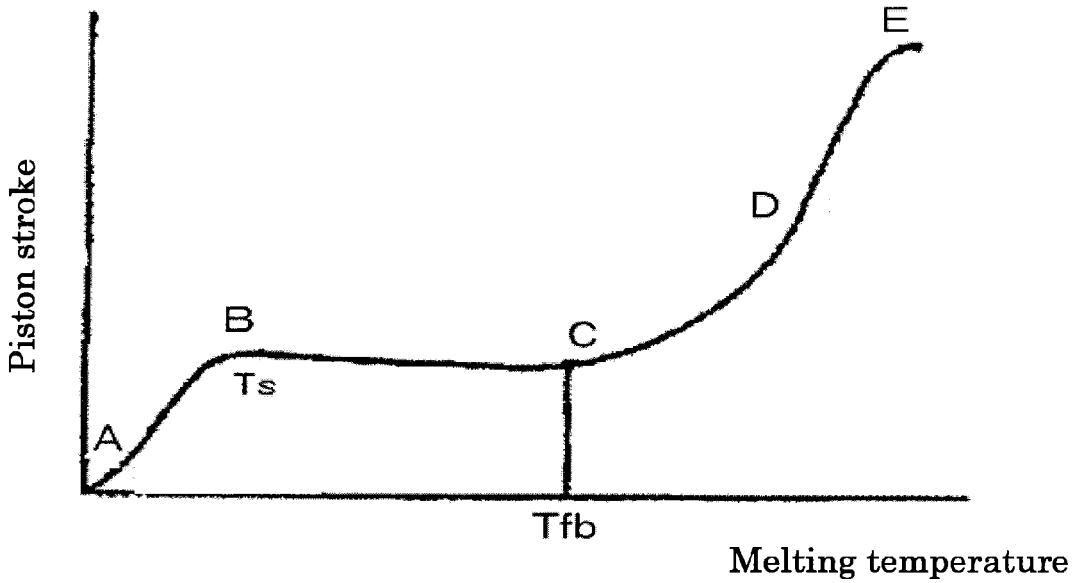
FIG. 5 is a flow curve obtained by a capillary rheometer.

The thus obtained flow curve of the capillary rheometer gives the data as depicted in FIG. 5, from which each temperature can be read.

In FIG. 5, A is a measuring onset temperature, B is Ts (softening temperature), C is Tfb (flow onset temperature), D is 1/2 outflow temperature, and E is measuring endset temperature.

As for the binder resin of the toner of the present invention, other than the aforementioned low molecular weight polyester, one, or two or more resins are used in combination. Such resin is appropriately selected as a binder resin for a toner from conventional resins without any limitation, and examples thereof include a polyester resin, a polyol resin, a polystyrene resin, and a polystyrene acryl resin.

In the case where a main component of the adhesive base of the toner is a polyester resin, a polyester resin is preferable, and a crystalline polyester resin is more preferable among them in view of compatibility during fixing, and improved low temperature fixing ability and improved glossiness when used for a full-color image forming apparatus.

Moreover, an amount of the polyester resin in the binder resin is preferably 50% by mass to 100% by mass, the acid value of the binder resin is preferably 1.0 mgKOH/g to 50.0 mgKOH/g, and the glass transition temperature of the binder resin is preferably 35° C. to 65° C.

Use of the crystalline polyester resin in combination with the low molecular weight polyester can achieve heat resistant storage stability. The crystalline polyester resin exhibits excellent heat resistant storage stability just below the flow onset temperature, and can provide a toner with a sharp-melt property at equal to or higher than the flow onset temperature, as the crystalline polyester resin functions together with the low molecular weight polyester to reduce a viscosity of a toner binder. Moreover, a releasing width (a difference between the minimum fixing temperature and hot offset occurring temperature) of a toner can be improved, which results in a toner with excellent fixing ability.

A mass ratio of the low molecular weight polyester to the crystalline polyester (low molecular weight polyester/crystalline polyester) is preferably 1.5 to 2, more preferably 1.7 to 1.8. When the mass ratio is less than 1.5, a resulting toner may have poor low temperature fixing ability. When the mass ratio is greater than 2, a resulting toner may have poor heat resistant storage stability.

Moreover, the solubility parameter (SP) value of the crystalline polyester SP(a), and the solubility parameter value of the low molecular weight polyester SP(b) preferably satisfy the following formula (2).

$$1.80 \geq |SP(b)-SP(a)| \geq 1.05 \quad \text{Formula (2)}$$

When the value of |SP(b)−SP(a)| is less than 1.05, chemical compositions of both resins are similar and compatibility thereof is high. Therefore, transesterification is induced and reduces crystallinity of the crystalline polyester, which may deteriorate shelf stability. Moreover, when the value thereof is greater than 1.80, compatibility thereof is excessively low, and therefore it may be difficult to dissolve crystalline polyester.

The solubility parameter can be adjusted by selections of a polyhydric alcohol component and polyvalent carboxylic acid.

Moreover, the solubility parameter (SP) value SP(a) of the crystalline polyester and the solubility parameter value of SP(b) of the low molecular weight polyester are each a solubility parameter obtained by calculating a mass fraction of an actual formulated amount of each monomer component used for polymerization, assuming that all polymerization unit are incorporated in a polymer chain with respective mass fraction and determining a solubility parameter of a polymerization unit calculated from each monomer component as represented by the following formula, and summing the values which are multiplied with a respective weight fraction.

Note that the solubility parameter used in the present invention is solubility parameter at 25° C., and is described for example in the aforementioned literature (R. F. Fedors, Polym. Eng. Sci., 14, 147 (1974)).

$$\delta_{overall}=\Sigma w_i(\Delta e_i/\Delta v_i)^{1/2} \quad \text{Formula (3)}$$

In the formula (3), $\delta_{overall}$ is solubility parameter [(cal/ml)$^{1/2}$/25° C.] of a polymer, $w_i$ is mass fraction calculated from each monomer, $\Delta e_i$ is a sum (cal/mol) of cohesive energy per unit functional group of each monomer component, and $\Delta v_i$ is a sum (cc/mol/25° C.) of molecular volume per unit functional group.

The crystalline polyester resin will be explained next.

The crystalline polyester resin is appropriately selected depending on the intended purpose without any limitation, and examples thereof preferably include polyester containing an aromatic component, and polyester containing the structure represented by the following structural formula (1). The polyester resin containing an aromatic component preferably contains the aromatic component in an amount larger than the amount of the aromatic component in the low molecular weight polyester.

Structural Formula (1)

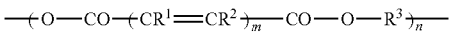

In the structural formula (1), $R^1$ and $R^2$ may be identical or different from each other, and each represents a hydrogen atom, or a hydrocarbon group.

The hydrocarbon group is appropriately selected depending on the intended purpose without any limitation, and examples thereof include an alkyl group, an alkenyl group, and an aryl group.

These may be further substituted with a substituent.

The alkyl group is preferably a C1-C10 alkyl group, and examples thereof include a methyl group, an ethyl group, a n-propyl group, an isopropyl group, a n-butyl group, an isobutyl group, a sec-butyl group, a n-hexyl group, an isohexyl group, a n-heptyl group, a n-octyl group, an isooctyl group, a n-decyl group, and an isodecyl group.

The alkenyl group is preferably a C2-C10 alkenyl group, and examples thereof include a vinyl group, an allyl group, a propenyl group, an isopropenyl group, a butenyl group, a hexenyl group, and an octenyl group.

The aryl group is preferably a C6-C24 aryl group, and examples thereof include a phenyl group, a tolyl group, a xylyl group, a cumenyl group, a styryl group, a mesityl group, a cinnamyl group, a phenethyl group, and a benzhydryl group.

Moreover, $R^3$ represents a C1-C20 divalent hydrocarbon group, and is preferably a C1-C10 divalent hydrocarbon group. Examples thereof include an alkylene group represented by $—(CH_2)_p—$ (provided that p is an integer of 1 to 20). Among them, particularly preferred are $—CH_2—$, $—CH_2CH_2—$, $—CH_2CH_2CH_2—$, and $—CH_2C(CH_3)H—$.

Moreover, m is an integer of 1 to 10, preferably 1 to 3. n denotes a polymerization degree, and represents an integer of 1 or greater.

The crystallinity, and molecular structure of the crystalline polyester resin can be confirmed by NMR, differential scanning calorimetry (DSC), X-ray diffraction, GC/MS, LC/MS, or infrared (IiR) absorption spectroscopy.

For example, the crystalline polyester resin preferably has absorption based on δCH (out-of-plane bending vibration) of olefin in a region of 965 $cm^{-1}$±10 $cm^{-1}$ and a region of 990 $cm^{-1}$±10 $cm^{-1}$ in an infrared absorption spectrum. In this case, the one exhibiting absorption can be determined as being crystalline.

A molecular weight distribution of the crystalline polyester resin is appropriately selected depending on the intended purpose without any limitation, but the molecular weight distribution thereof is preferably sharp, and is preferably as lower molecular weight as possible as low temperature fixing ability is improved. In the molecular weight distribution diagram obtained by gel permeation chromatography (GPC) of an orthodichlorobenzene soluble component, which represents log (M) on the transverse axis, and % by mass on the vertical axis, it is preferred that a position of a peak fall within the range of 3.5 to 4.0, and a half width of the peak be 1.5 or less.

The weight average molecular weight (Mw) of the crystalline polyester resin is appropriately selected depending on the intended purpose without any limitation, but it is, for example, preferably 1,000 to 30,000, more preferably 1,200 to 20,000. When the weight average molecular weight thereof is smaller than 1,000, storage stability may be impaired. When the weight average molecular weight thereof is greater than 30,000, sharp melt properties may be impaired.

The number average molecular weight (Mn) of the crystalline polyester resin is appropriately selected depending on the intended purpose without any limitation, but it is, for example, preferably 500 to 6,000, and more preferably 700 to 5,500. When the number average molecular weight thereof is smaller than 500, storage stability may be impaired. When the number average molecular weight thereof is greater than 6,000, sharp melt properties may be impaired.

A molecular weight distribution (Mw/Mn) represented by a ratio of the weight average molecular weight (Mw) to the number average molecular weight (Mn) is appropriately selected depending on the intended purpose without any limitation, but it is, for example, preferably 2 to 8.

When the molecular weight distribution (Mw/Mn) is less than 2, production thereof is difficult and requires a large cost. When the molecular weight distribution (Mw/Mn) thereof is greater than 8, sharp melt properties may be impaired.

The melting temperature (Tin) (may be also referred to as "F1/2 temperature") of the crystalline polyester resin is appropriately selected depending on the intended purpose without any limitation, but it is, for example, preferably 50° C. to 150° C., more preferably 60° C. to 130° C., as determined by a DSC endothermic peak temperature on a DSC curve as measured by differential scanning caloritometory (DSC). When the melting temperature (Tm) is lower than 50° C., heat resistant storage stability lowers, and may easily cause blocking at an internal temperature of a developing device. When the melting temperature (Tm) is higher than 150° C., the minimum fixing temperature becomes high, and therefore it cannot achieve low temperature fixing ability.

The acid value of the crystalline polyester resin is appropriately selected depending on the intended purpose without any limitation, but it is, for example, preferably 5 mgKOH/g or greater, more preferably 10 mgKOH/g or greater.

Note that, the acid value thereof is preferably 45 mgKOH/g or lower for improving hot offset resistance.

When the acid value is lower than 5 mgKOH/g, affinity between paper and the resin, and intended low temperature fixing ability of a resulting toner may not be attained.

The acid value of the crystalline polyester resin can be measured, for example, by dissolving the crystalline polyester resin in 1,1,1,3,3,3-hexafluoro-2-propanol, and subjected to titration.

The hydroxyl value of the crystalline polyester resin is appropriately selected depending on the intended purpose without any limitation, but it is, for example, preferably 0 mgKOH/g to 50 mgKOH/g, more preferably 5 mgKOH/g to 50 mgKOH/g. When the hydroxyl value thereof is greater than 50 mgKOH/g, a resulting toner may not be able to achieve predetermined low temperature fixing ability, and excellent charging properties.

The hydroxyl value of the crystalline polyester resin can be measured, for example, by dissolving the crystalline polyester resin in 1,1,1,3,3,3-hexafluoro-2-propanol, and subjecting to titration.

The crystalline polyester resin can be synthesized, for example, through a polyaddition reaction between an alcohol component and an acid component.

The alcohol component is appropriately selected depending on the intended purpose without any limitation, and examples thereof suitably include a diol compound.

For example, the diol compound is preferably a C2-C8 diol compound, more preferably a C2-C6 diol compound, and examples thereof include 1,4-butanediol, ethylene glycol, 1,2-propylene glycol, 1,3-propylene glycol, 1,6-hexanediol, neopentyl glycol, 1,4-butenediol, 1,5-pentanediol, bisphenol A alkylene oxide adducts thereof, and derivatives thereof.

These may be used independently, or in combination.

Among them, 1,4-butanediol and 1,6-hexanediol are preferable.

An amount of the diol compound used in the alcohol component is preferably 80 mol % or greater, more preferably 85 mol % to 100 mol %.

When the amount of the diol compound in the alcohol component is smaller than 80 mol %, production efficiency may be impaired.

The acid component is appropriately selected depending on the intended purpose without any limitation, and examples thereof preferably include carboxylic acid having a carbon double bond, a dicarboxylic acid compound, and a polyvalent carboxylic acid compound. Among them, a dicarboxylic acid compound is preferable.

The dicarboxylic acid compound is, for example, preferably a C2-C8 dicarboxylic acid compound, more preferably a C2-C6 dicarboxylic acid compound. Examples thereof include oxalic acid, malonic acid, maleic acid, fumaric acid, citraconic acid, itaconic acid, glutaconic acid, succinic acid, adipic acid, phthalic acid, isophthalic acid, terephthalic acid, naphthalene dicarboxylic acid, anhydrides thereof, and C1-C3 alkyl esters thereof.

These may be used independently, or in combination.

Among them, fumaric acid is preferable.

An amount of the dicarboxylic acid compound used in the acid component is preferably 80 mol % or greater, more preferably 85 mol % to 100 mol %.

When the amount of the dicarboxylic acid compound in the acid component is smaller than 80 mol %, production efficiency may be impaired.

Examples of the polyvalent carboxylic acid compound include trimellitic acid, pyromellitic acid, anhydrides thereof, and a C1-C3 alkyl ester thereof.

The polyaddition reaction is appropriately selected depending on the intended purpose without any limitation, and for example, the polyaddition reaction can be carried out at 120° C. to 230° C. in an inert gas atmosphere using an esterification catalyst, polymerization inhibitor, or the like.

When the polyaddition reaction is carried out, all monomers may be charged at once for the purpose of enhancing strength of a resulting polyester resin. Moreover, trivalent or higher monomers may be added and reacted after reacting bivalent monomers for the purpose of reducing low molecular weight components. Furthermore, a reaction system may be reduced its pressure in the latter stage of the polyaddition reaction for the purpose of accelerating the reaction. Further, trihydric or higher polyhydric alcohol, such as glycerin, may be added as the alcohol component and trivalent or higher polycarboxylic acid, such as trimellitic anhydride, may be added as the acid component during the polyaddition reaction to generate non-linear polyester for the purpose of controlling crystallinity and softening point of the crystalline polyester resin.

Moreover, a modified polyester resin (MPE) reactive with a compound having an active hydrogen group may be used for the purpose of improving heat resistant storage stability. It is preferred that at least part of the modified polyester resin be compatible with other binder resin components, in view of low temperature fixing ability and hot offset resistance.

Accordingly, the modified polyester component and other binder resin components are preferably composed of similar compositions (monomers).

The reactive modified polyester resin (RMPE) that is reactive with a compound having an active hydrogen group includes, for example, polyester prepolymer having a functional group reactive with active hydrogen, such as an isocyanate group (the polyester-based resin may be merely referred to as polyester, hereinafter).

The polyester prepolymer preferably used in the present invention is an isocyanate group-containing polyester prepolymer (A).

The isocyanate group-containing polyester prepolymer (A) is produced by reacting polyester, which is a polycondensation product of polyol (PO) and polycarboxylic acid (PC), and has an active hydrogen group, with polyisocyanate (PIC).

Examples of the active hydrogen group contained in the polyester include a hydroxyl group (e.g., an alcoholic hydroxyl group, and a phenolic hydroxyl group), an amino group, a carboxyl group, and a mercapto group. Among them, preferred is an alcoholic hydroxyl group.

Examples of the polyol include diol (DIO), and trihydric or higher polyol (TO), and the polyol is preferably DIO alone, or a mixture of DIO and a small amount of TO.

Examples of the diol include alkylene glycol (e.g., ethylene glycol, 1,2-propylene glycol, 1,3-propylene glycol, 1,4-butanediol, and 1,6-hexanediol); alkylene ether glycol (e.g., diethylene glycol, triethylene glycol, dipropylene glycol, polyethylene glycol, polypropylene glycol, and polytetramethylene ether glycol); alicyclic diol (e.g., 1,4-cyclohexane dimethanol, and hydrogtenated bisphenol A); bisphenols (e.g., bisphenol A, bisphenol F, and bisphenol S); alkylene oxide (e.g., ethylene oxide, propylene oxide, and butylene oxide) adducts of the foregoing alicyclic diols; and alkylene oxide (e.g., ethylene oxide, propylene oxide, and butylene oxide) adducts of the foregoing bisphenols.

Among them, preferred are C2-C12 alkylene glycol and alkylene oxide adducts of bisphenols, and particularly preferred are alkylene oxide adducts of bisphenols, and a combination of alkylene oxide adducts of bisphenols can C2-C12 alkylene glycol.

Examples of the trihydric or higher polyol include: trihydric to octahydric or higher polyhydric aliphatic alcohol (e.g., glycerin, trimethylol ethane, trimethylol propane, pentaerythritol, and sorbitol); trihydric or higher phenols (e.g., trisphenol PA, phenol novolak, and cresol novolak); and alkylene oxide adducts of the foregoing trihydric or higher polyphenols.

Examples of the polycarboxylic acid (PC) include dicarboxylic acid (DIC), and trivalent or higher polycarboxylic acid (TC). Among them, preferred are DIC alone, and a mixture of DIC and a small amount of TC.

Examples of the dicarboxylic acid include: alkylene dicarboxylic acid (e.g., succinic acid, adipic acid, and sebasic acid); alkenylene dicarboxylic acid (e.g., maleic acid, and fumaric acid); and aromatic dicarboxylic acid (e.g., phthalic acid, isophthalic acid, terephthalic acid, naphthalene dicarboxylic acid).

Among them, preferred are C4-C20 alkenylene dicarboxylic acid, and C8-C20 aromatic dicarboxylic acid.

Examples of the trivalent or higher polycarboxylic acid include C9-C20 aromatic polycarboxylic acid (e.g., trimellitic acid, and pyromellitic acid).

Note that, as the polycarboxylic acid, acid anhydrides or lower alkyl ester (e.g., methyl ester, ethyl ester, isopropyl ester) of any of the above-listed polycarboxylic acid may be used, and may be reacted with a polyol.

A ratio of the polyol to the polycarboxylic acid is determined with an equivalent ratio [OH]/[COOH] of hydroxyl groups [OH] to carboxyl groups [COOH], which is typically 2/1 to 1/1, preferably 1.5/1 to 1/1, and more preferably 1.3/1 to 1.02/1.

Examples of the polyisocyanate (PIC) include: aliphatic polyisocyanate (e.g., tetramethylene diisocyanate, hexamethylene diisocyanate, and 2,6-diisocyanatomethyl caproate); alicyclic polyisocyanate (e.g., isophorone diisocyanate, and cyclohexyl methane diisocyanate); aromatic diisocyanate (e.g., tolylene diisocyanate, and diphenyl methane diisocyanate); aromatic aliphatic diisocyanate (e.g., $\alpha,\alpha,\alpha',\alpha'$-tetramethylxylene diisocyanate); isocyanurates; compounds in which the polyisocyanate is blocked with a phenol derivative, oxime, or caprolactam; and a mixture of two or more selected from the foregoing polyisocyanates.

A ratio of the polyisocyanate is determined as an equivalent ratio [NCO]/[OH] of isocyanate groups [NCO] to hydroxyl groups [OH] of polyester having hydroxyl groups, which is typically 5/1 to 1/1, preferably 4/1 to 1.2/1, and more preferably 2.5/1 to 1.5/1. When the ratio [NCO]/[OH] is greater than 5, low temperature fixing ability of a resulting toner is poor.

When a molar ratio of [NCO] is less than 1, a urea content of the modified polyester is low, which may impair hot offset resistance.

An amount of polyisocyanate (PIC) constituting component in the prepolymer having an isocyanate group at terminal thereof is typically 0.5% by mass to 40% by mass, preferably 1% by mass to 30% by mass, and more preferably 2% by mass to 20% by mass.

When the amount thereof is smaller than 0.5% by mass, hot offset resistance of a resulting toner may be impaired and heat resistant storage stability and low temperature fixing ability may not be attained together. When the amount thereof is greater than 40% by mass, low temperature fixing ability may be impaired.

A number of isocyanate groups contained per molecule of the isocyanate group-containing polyester prepolymer (A) is typically 1 or more, preferably 1.5 to 3 on average, and more preferably 1.8 to 2.5 on average.

When the number thereof per molecule is less than 1, a molecular weight of the urea-modified polyester is small, which may impair hot offset resistance.

A urea-modified polyester resin (UMPE) can be obtained from the polyester prepolymer (A) having an isocyanate group, by reacting the polyester prepolymer (A) having an isocyanate group with amines (B). The urea-modified polyester resin (UMPE) exhibits an excellent effect as a toner binder.

Examples of the amines (B) as the compound containing an active hydrogen group include diamine (B1), trivalent or higher polyamine (B2), aminoalcohol (B3), aminomercaptam (B4), amino acid (B5), and compounds in which an amino group of the foregoing B1 to B5 is blocked (B6).

Examples of the diamine (B1) include aromatic diamine (e.g., phenylene diamine, diethyl toluene diamine, and 4,4'-diaminodiphenyl methane); alicyclic diamine (e.g., 4,4'-diamino-3,3'-dimethyldicyclohexyl methane, diamine cyclohexane, and isophorone diamine); and aliphatic diamine (e.g., ethylene diamine, tetramethylene diamine, and hexamethylene diamine).

Examples of the trivalent or higher polyamine (B2) include diethylene triamine, triethylene tetramine.

Examples of the aminoalcohol (B3) include ethanol amine, and hydroxyethyl aniline.

Examples of the aminomercaptam (B4) include amino ethyl mercaptan, and amino propyl mercaptan.

Examples of the amino acid (B5) include aminopropionic acid, and aminocaproic acid.

Examples of the compound in which the amino group of the B1 to B5 is blocked (B6) include a ketimine compound obtained from the amines of B1 to B5 and ketones (e.g., acetone, methyl ethyl ketone, and methyl isobutyl ketone), and an oxazoline compound.

Among these amines (B), preferred are B1, and a mixture of B1 and a small amount of B2.

Further, a molecular weight of modified polyester such as urea-modified polyester can be adjusted using an elongation inhibitor, if necessary.

Examples of the elongation inhibitor include monoamine (e.g., diethylamine, dibutylamine, butylamine, and laurylamine), and those obtained by blocking the monoamine (e.g., a ketimine compound).

A ratio of the amines (B) is determined with an equivalent ratio [NCO]/[NHx] of isocyanate groups [NCO] in the prepolymer having an isocyanate group, to amino groups [NHx] in the amine (B), which is typically 1/2 to 2/1, preferably 1.5/1 to 1/1.5, and more preferably 1.2/1 to 1/1.2.

When the ratio [NCO]/[NHx] is greater than 2, or lower than 1/2, a molecular weight of urea-modified polyester is small, which may impair hot offset resistance.

The amines (B) function as a crosslinking agent or chain-elongation agent for modified polyester reactable with a compound having an active hydrogen group.

In the present invention, polyester modified with a urea bond may contain a urethane bond as well as the urea bond.

A molar ratio of the amount of the urea bond to the amount of the urethane bond is typically 100/0 to 10/90, preferably 80/20 to 20/80, and more preferably 60/40 to 30/70.

When the molar ratio of the urea bond is less than 10%, hot offset resistance of a resulting toner may be impaired.

The urea-modified polyester for use in the present invention is produced by a one-shot method, or a prepolymer method.

The urea-modified polyester for use in the present invention is produced a one-shot method or a prepolymer method described later. for example, polyol and polycarboxylic acid are heated to 150° C. to 280° C. in the presence of a conventional esterification catalyst, such as tetrabutoxy titanate, and dibutyl tin oxide, and generated water is removed optionally under the reduced pressure, to thereby obtain polyester having a hydroxyl group.

Next, the resulting polyester having a hydroxyl group is allowed to react with polyisocyanate at 40° C. to 140° C., to thereby obtain prepolymer (A) having an isocyanate group.

Further, the prepolymer (A) is allowed to react with amine (B) at 0° C. to 140° C., to thereby obtain polyester modified with a urea bond.

When polyisocyanate is reacted, or when A and B are allowed to react, a solvent may be used, if necessary.

Examples of a usable solvent include those inert to polyisocyanate (PIC), such as an aromatic solvent (e.g., toluene, and xylene); ketones (e.g., acetone, methyl ethyl ketone, and methyl isobutyl ketone); esters (e.g., ethyl acetate); amides (e.g., dimethyl formamide, and dimethyl acetoamide); and ethers (e.g., tetrahydrofuran).

In the case where polyester (PE) that is not modified with a urea bond is used in combination, PE is produced in the same manner as in the production of polyester having a hydroxyl group, and a resultant is dissolved in the solution that completed the aforementioned reaction of the urea-modified polyester, and mixed.

The weight average molecular weight of the modified polyester such as urea-modified polyester is typically 10,000 or greater, preferably 20,000 to 10,000,000, even more preferably 30,000 to 1,000,000.

When the weight average molecular weight thereof is smaller than 10,000, hot offset resistance may be impaired. The number average molecular weight of the modified polyester such as urea-modified polyester is not particularly limited, and may be the number average molecular weight with which the aforementioned weight average molecular weight is easily attained.

A mass ratio of MPE to other components of the binder resin is typically 5/95 to 80/20, preferably 5/95 to 30/70, more preferably 5/95 to 25/75, and even more preferably 7/93 to 20/80.

When the mass ratio of MPE is less than 5%, hot offset resistant of a resulting toner may be impaired, and it is disadvantageous for realizing both heat resistant storage stability and low temperature fixing ability.

With regard to the storage elastic modulus of the toner binder as a whole, the temperature (TG') at which the storage elastic modulus becomes 10,000 dyne/cm with a measuring frequency of 20 Hz is typically 100° C. or higher, preferably 110° C. to 200° C. When the temperature (TG') is lower than 100° C., hot offset resistance of a resulting toner may be impaired.

With regard to viscosity of the toner binder as a whole, temperature (Tη) at which the viscosity becomes 1,000 P with a measuring frequency of 20 Hz is typically 180° C. or lower, preferably 90° C. to 160° C. When the temperature (Tη) is higher than 180° C., low temperature fixing ability of a resulting toner may be impaired.

Specifically, TG' is preferably higher than Tη in order to achieve both low temperature fixing ability and hot offset resistance. In other words, a difference between TG' and Tη (TG'−Tη) is preferably 0° C. or more, more preferably 10° C. or more, and even more preferably 20° C. or more, and the upper limit of the difference is not particularly limited.

Moreover, a difference between Tη and Tg is preferably 0° C. to 100° C. for attaining both heat resistant storage stability and low temperature fixing ability. More preferred is 10° C. to 90° C., and particularly preferred is 20° C. to 80° C., Since the modified polyester, such as a urea-modified polyester resin, is present together as a binder resin, a resulting toner exhibits excellent heat resistant storage stability with low glass transition temperature, compared to a conventional polyester-based toner.

The glass transition temperature (Tg) of the toner binder as a whole is appropriately selected depending on the intended purpose without any limitation, but it is, for example, preferably 30° C. to 80° C., more preferably 40° C. to 65° C., and even more preferably 55° C. to 65° C.

When the glass transition temperature (Tg) thereof is lower than 30° C., heat resistant storage stability may be impaired. When the glass transition temperature (Tg) thereof is higher than 80° C., low temperature fixing ability may be impaired.

The weight average molecular weight (Mw) of the toner binder as a whole is appropriately selected depending on the intended purpose without any limitation, but it is, for example, preferably 2,000 to 90,000, more preferably 2,500 to 30,000.

When the weight average molecular weight thereof is smaller than 2,000, heat resistant storage stability may be impaired. When the weight average molecular weight thereof is greater than 90,000, low temperature fixing ability may be impaired.

<Colorant>

As for the colorant, conventional dyes and pigments are all used without any limitation, and examples of the colorant include carbon black, a nigrosin dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red FSR, brilliant carmine 6B, pigment scarlet 3B, Bordeaux 5B, toluidine Maroon, permanent Bordeaux F2K, Helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS and BC), indigo, ultramarine, iron blue, anthraquinone blue, fast violet B, methyl violet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, lithopone, and a mixture thereof.

An amount of the colorant in the toner is typically preferably 1% by mass to 15% by mass, more preferably 3% by mass to 10% by mass.

The colorant may form a composite with a resin, which may be used as a master batch. Use of the master batch can prevent reduction in the compatibility between the crystalline polyester and the pigment and can realize a toner having high coloring performance.

Examples of the binder resin used for production of the master batch or kneaded together with the master batch include, other than the modified and unmodified polyester resins described above, polymer of styrene or substituent thereof (e.g., polystyrene, poly-p-chlorostyrene, polyvinyltoluene), styrene copolymer (e.g., styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinylmethylketone copolymer, styrene-butadiene copolymer, styrene-isoprene copolymer, styrene-acrylonitrile-indene copolymer, styrene-maleic acid copolymer, and styrene-maleic acid ester copolymer), and others, such as polymethyl methacrylate, polybutyl methacrylate, polyvinyl chloride, polyvinyl acetate, polyethylene, polypropylene, polyester, an epoxy resin, an epoxy polyol resin, polyurethane, polyamide, polyvinyl butyral, polyacrylic acid resin, rosin, modified rosin, a terpene resin, an aliphatic or alicyclic hydrocarbon resin, an aromatic petroleum resin, chlorinated paraffin, and paraffin wax. These may be used independently, or as a mixture.

A master batch can be obtained by mixing a resin for master batch and a colorant with high shearing force, followed by kneading.

In order to enhance the interaction between the colorant and the resin during the formation of the master batch, an organic solvent may be used.

Moreover, the master batch can be prepared by a flashing method in which an aqueous paste containing a colorant is mixed and kneaded with a resin and an organic solvent, and then the colorant is transferred to the resin to remove the water and the organic solvent. This method is preferably used because a wet cake of the colorant is used as it is, and it is not necessary to dry the wet cake of the colorant to prepare a colorant.

In the mixing and kneading of the colorant and the resin, a high-shearing disperser, such as a three-roll mill, is preferably used.

<Releasing Agent>

The toner of the present invention may contain wax as a releasing agent, together with the toner binder and the colorant.

As for the wax, conventional wax can be used without any limitation. Examples of the wax include: polyolefin wax (e.g., polyethylene wax, and polypropylene wax); long chain hydrocarbon (e.g., paraffin wax, and Sasol wax); and a carbonyl-group containing wax.

Among them, preferred is carbonyl group-containing wax.

Examples of the carbonyl group-containing wax include: polyalkanoic acid ester (e.g., carnauba wax, montan wax, trimethylol propane tribehenate, pentaerythritol tetrabehenate, pentaerythritol diacetate dibehenate, glycerin tribehenate, and 1,18-octadecanediol distearate); polyalkanol ester (e.g., tristearyl trimellitate, and distearyl maleate); polyalkanoic acid amide (e.g., ethylenediamine dibehenylamide); polyalkyl amide (e.g., trimellitic acid tristearyl amide); and dialkylketone (e.g., distearyl ketone).

Among these carbonyl group-containing wax, preferred is polyalkanoic acid ester.

The melting point of the wax is typically 40° C. to 160° C., preferably 50° C. to 120° C., more preferably 60° C. to 90° C. When the melting point thereof is lower than 40° C., it adversely affects heat resistant storage stability. When the melting point thereof is higher than 160° C., cold offset tends to occur during fixing at low temperature.

Moreover, melt viscosity of the wax is determined with a measuring value thereof at temperature that is higher than a melting point of the wax by 20° C., which is preferably 5 cps to 1,000 cps, more preferably 10 cps to 100 cps. When the melt viscosity is higher than 1,000 cps, an effect of improving hot offset resistance and low temperature fixing ability of a toner may be reduced.

An amount of the wax in the toner is typically 0% by mass to 40% by mass, preferably 3% by mass to 30% by mass.

<Charge Controlling Agent>

The toner of the present invention may contain a charge controlling agent, if necessary.

As for the charge controlling agent, any of conventional charge controlling agents can be used without any limitation. Examples of the charge controlling agent include nigrosine dye, triphenylmethane dye, chrome-containing metal complex dye, molybdic acid chelate pigment, rhodamine dye, alkoxy amine, quaternary ammonium salt (including fluorine-modified quaternary ammonium salt), alkylamide, phosphorus, phosphorus compound, tungsten, tungsten compound, fluorine active agent, metal salt of salicylic acid, and metal salt of salicylic acid derivatives.

Specific examples thereof include: nigrosine dye BONTRON 03, quaternary ammonium salt BONTRON P-51, metal-containing azo dye BONTRON S-34, oxynaphthoic acid-based metal complex E-82, salicylic acid-based metal complex E-84 and phenol condensate E-89 (all manufactured by ORIENT CHEMICAL INDUSTRIES CO., LTD); quaternary ammonium salt molybdenum complex TP-302 and TP-415 (all manufactured by Hodogaya Chemical Co., Ltd.); quaternary ammonium salt COPY CHARGE PSY VP 2038, triphenylmethane derivative COPY BLUE PR, quaternary ammonium salt COPY CHARGE NEG VP2036 and COPY CHARGE NX VP434 (all manufactured by Hoechst AG); LRA-901, and boron complex LR-147 (manufactured by Japan Carlit Co., Ltd.); copper phthalocyanine; perylene; quinacridone; azo pigments; and polymeric compounds having, as a functional group, a sulfonic acid group, carboxyl group, quaternary ammonium salt, etc.

An amount of the charge controlling agent is determined depending on a type of a toner binder resin, presence of additives optionally used, and a toner production method including a dispersing method, and therefore it cannot be limited conclusively. It is, however, preferably 0.1 parts by mass to 10 parts by mass, more preferably 0.2 parts by mass to 5 parts by mass, relative to 100 parts by mass of the toner binder resin.

When the amount thereof is greater than 10 parts by mass, electrostatic propensity of a resulting toner is excessive, which lowers an effect of a main charge controlling agent, and increases an electrostatic attraction force of the toner to a developing roller. As a result, flowability of a developer, and image density may be degraded or lowered.

The charge controlling agent may be melt-kneaded together with a master batch, and/or resin, followed by dissolved and dispersed. The charge controlling agent can be, of course, directly added during dissolution and dispersion, or may be fixed on a surface of a toner particle after forming toner particles.

The toner of the present invention preferably contains resin particles, or a layered inorganic mineral, in which at least part of ions present between layers of the layered inorganic mineral are modified with organic ions, for the purpose of heat resistant storage stability. The resin particles can be located on a surface of a toner base particle by dispersing the resin particles in an aqueous phase, followed by making them migrate to the side of an oil phase. In addition, the layered inorganic mineral can be located on a surface of a toner base particle, as the layered inorganic mineral is pushed out to a surface of an oil droplet by dispersing the layered inorganic mineral in an oil phase.

<Resin Particles>

The resin particles essentially have glass transition temperature (Tg) of 50° C. to 70° C. When the glass transition temperature (Tg) of the resin particles is lower than 50° C., storage stability of a resulting toner may be impaired, and therefore blocking may occur during storage or within a developing device. When the glass transition temperature (Tg) thereof is higher than 70° C., the resin particles inhibits adhesion between a resulting toner and fixing paper, which elevates the minimum fixing temperature.

Moreover, the weight average molecular weight of the resin particles is preferably 100,000 or smaller. Preferably, the weight average molecular weight thereof is 50,000 or smaller. The lower limit of the weight average molecular weight thereof is typically 4,000. When the weight average molecular weight is greater than 100,000, the resin particles inhibit adhesion between a resulting toner and fixing paper, which elevates the minimum fixing temperature.

As for the resin particles, any resin can be used as long as it can form an aqueous dispersion liquid, and such resin may be a thermoplastic resin or a thermoset resin. Examples thereof include a vinyl resin, a polyurethane resin, an epoxy resin, a polyester resin, a polyamide resin, a polyimide resin, a silicon resin, a phenol resin, a melamine resin, a urea resin, an aniline resin, an iomer resin, and a polycarbonate resin.

As for the resin particles, two or more selected from the foregoing resins may be used in combination without any problem.

Among them, more preferred are a vinyl resin, a polyurethane resin, an epoxy resin, a polyester resin, and a mixture of these resins, as an aqueous dispersion liquid of fine spherical resin particles are easily obtained.

The vinyl resin is a polymer obtained by homopolymerization or copolymerization of vinyl monomers, and examples thereof include a styrene-(meth)acrylate resin, a styrene-butadiene copolymer, a (meth)acrylic acid-acrylate polymer, a styrene-acrylonitrile copolymer, styrene-maleic anhydride copolymer, and styrene-(meth)acrylic acid copolymer.

The average particle diameter of the resin particles is preferably 5 nm to 200 nm, more preferably 20 nm to 150 nm.

<Layered Inorganic Mineral>

A modified layered inorganic mineral is preferably a layered inorganic mineral having a basic smectite crystal structure, which is modified with organic cations. Moreover, metal cations can be introduced into the layered inorganic mineral by substituting part of bivalent metals in the layered inorganic mineral with trivalent metals. Since hydrophilicity is enhanced by introduction of metal anions, the layered inorganic compound in which at least part of metal cations is modified with organic anions is preferable.

Examples an organic ion modifying agent of the layered inorganic mineral in which at least part of ions therein is modified with organic ions include a quaternaly alkyl ammonium salt, a phosphonium salt, and an imidazolium salt. The quaternary alkyl ammonium salt is preferable. Examples of the quaternary alkyl ammonium include trimethylstearyl ammonium, dimethylstearylbenzyl ammonium, dimethyloctadecyl ammonium, and oleyl bis(2-hydroxyethyl)methyl ammonium.

Examples of the organic ion modifying agent include sulfuric acid salt, sulfonic acid salt, carboxylic acid salt, and phosphoric acid salt having branched, non-branched, or cyclic alkyl (C1 to C44), alkenyl (C1 to C22), alkoxy (C8 to C32), hydroxyalkyl (C2 to C22), ethylene oxide, or propylene oxide. Among them, carboxylic acid having an ethylene oxide skeleton is preferable.

By modifying at least part of the layered inorganic mineral with organic ions, the layered inorganic mineral has an appropriate degree of hydrophilicity, an oil phase containing a toner composition and/or toner composition precursor has non-Newtonian viscosity so that toner particles can be formed with irregular shapes. An amount of the layered inorganic mineral part of which is modified with organic ions in the toner material is preferably 0.05% by mass to 2% by mass.

The layered inorganic mineral part of which is modified with organic ion is appropriately selected, and examples thereof include montmorillonite, bentonite, hectorite, attapulgite, saponite, and a mixture thereof. Among them, organic modified montmorillonite or bentonite is preferable, as it can easily adjust viscosity with a small amount thereof without adversely affecting properties of a resulting toner.

Examples of a commercial product of the layered inorganic mineral part of which is modified with organic cations include: octanium-18 bentonite, such as BENTONE 3, BENTONE 38, BENTONE 38V (all manufactured by Rheox Corporation), TIXOGEL VP (manufactured by United Catalyst, LLC), CLAYTONE 34, CLAYTONE 40, and CLAYTONE XL (all manufactured by Southern Clay Products Inc.); stearalkonium bentonite such as BENTONE 27(manufactured by Rheox Corporation), TIXOGEL LG (manufactured by United Catalyst, LLC), and CLAYTONE AF (manufactured by Southern Clay Products Inc.); and octanium-18/benzalkonium bentonite, such as CLAYTONE HT, CLAYTONE PS (manufactured by Southern Clay Products Inc.). Among them, CLAYTONE AF, and CLAYTONE APA are particularly preferable.

As for the layered inorganic mineral part of which is modified with organic anions, DHT-4A (manufactured by Kyowa Chemical Industry Co., Ltd.) modified with an organic anion represented by the following general formula (1) is particularly preferable. Examples of the organic anion represented by the general formula (1) include HITENOL 330T (manufactured by Dai-ichi Kogyo Seiyaku Co., Ltd.).

$$R_1(OR_2)_nOSO_3M \qquad \text{General Formula (1)}$$

[in the formula above, $R_1$ is a C13 alkyl group, and $R_2$ is a C2-C6 alkylene group. n is an integer of 2 to 10, and M is a monovalent metal element.]

As the modified layered inorganic mineral has an appropriate degree of hydrophobicity, the modified layered inorganic mineral tends to present at an interface of droplet to thereby locally present on a surface of a resulting toner particle. As a result, the modified layered inorganic mineral provides a resulting toner with heat resistant storage stability, and charging properties.

<External Additive>

Inorganic particles can be preferably used as an external additive for aiding flowability, developability, and charging ability of the color resin particles (toner base particles) obtained in the present invention.

Primary particle diameters of the inorganic particles are preferably 5 nm to 100 nm, more preferably 10 nm to 50 nm.

Moreover, a BET specific surface area thereof is preferably 20 $m^2/g$ to 500 $m^2/g$. A ratio of the inorganic particles for use is preferably 0.01% by mass to 5% by mass, more preferably 0.01% by mass to 2.0% by mass, relative to the toner.

Specific examples of the inorganic particles include silica, alumina, titanium oxide, barium titanate, magnesium titanate, calcium titanate, strontium titanate, zinc oxide, tin oxide, quartz sand, clay, mica, wollastonite, diatomaceous earth, chromic oxide, cerium oxide, red iron oxide, antimony trioxide, magnesium oxide, zirconium oxide, barium sulfate, barium carbonate, calcium carbonate, silicon carbide, and silicon nitride.

Other examples of the external additive include polymer particles, such as particles produced by soap-free emulsification polymerization, suspension polymerization, or dispersion polymerization (e.g. polystyrene particles, (meth)acrylic acid ester copolymer particles); polymer particles produced by polymerization condensation such as silicone particles, benzoguanamine particles, and nylon particles; and polymer particles of thermoset resins.

The external additive for imparting flowability can be subjected to a surface treatment to increase hydrophobicity, and to prevent deterioration of flow properties or charging properties in a high humidity environment.

Examples thereof include a silane coupling agent, a sililating agent, a silane coupling agent containing a fluoroalkyl group, an organic titanate-based coupling agent, an aluminum-based coupling agent, silicone oil, and modified silicone oil.

A cleaning improving agent may be added for removing the developer remained on a photoconductor or primary transferring member after transferring, and examples of such cleaning improving agent include: fatty acid metal salts such as zinc stearate, calcium stearate, stearic acid; and polymer particles produced by soap-free emulsification polymerization, such as polymethyl methacrylate particles, and polystyrene particles.

The polymer particles are preferably polymer particles having a relatively narrow particle size distribution, and the volume average particle diameter of 0.01 μm to 1 μm.

A production method of the toner will be explained next.

The toner of the present invention can be produced in the following method, but obviously not limited thereto.

<Toner Production Method in Aqueous Medium>

The toner of the present invention uses toner base particles, where the toner base particles are obtained by dissolving in an aqueous medium an oil phase prepared by dissolving or dispersing in an organic solvent a toner material containing a binder resin and/or a binder resin precursor, a colorant, and releasing agent, optionally performing a deformation treatment, and removing the solvent, washing, and drying. A suspension polymerization method, an emulsification polymerization method, and a polymer suspension method may be also used.

The aqueous medium may be water along, or in combination of water and a solvent miscible with water.

Examples of the solvent miscible with water include alcohol (e.g., methanol, isopropanol, and ethylene glycol), dimethyl formamide, tetrahydrofuran, cellosolves (e.g., methyl cellosolve), and lower ketones (e.g., acetone, and methyl ethyl ketone).

The toner particles can be formed by allowing dispersed element each formed of the prepolymer (A) to react with the amine (B) in an aqueous medium.

As for a method for stably forming dispersed elements each formed of a urea-modified polyester or prepolymer (A) in an aqueous medium, included is a method for adding components of toner raw materials including urea-modified polyester or prepolymer (A) to an aqueous medium, and dispersing with shearing force.

The prepolymer (A) and other toner components (may be referred to as "toner raw materials" hereinafter), such as a colorant, a colorant master batch, a releasing agent, a charge controlling agent, and a binder resin (a unmodified polyester resin) may be mixed when dispersed elements are formed in an aqueous medium. More preferred is a method in which toner raw materials are mixed in advance, followed by adding and dispersing the resulting mixture in an aqueous medium.

In the present invention, moreover, other toner raw materials such as a colorant, a releasing agent, and a charge controlling agent may not be necessarily mixed during formation of particles in an aqueous medium, and they may be added after forming particles.

For example, after forming particles each of which does not include a colorant, a colorant may be added by a conventional dyeing method.

A method for dispersing is not particularly limited, but conventional equipments, such as a low-speed shearing disperser, a high-speed shearing disperser, a friction disperser, a high-pressure jetting disperser and an ultrasonic wave disperser, can be employed.

Use of the high-speed shearing disperser is preferable to yield dispersed elements having particle diameters of 2 μm to 20 μm.

When the high-speed shearing disperser is used for the dispersion, the revolution number thereof is not particularly limited, but it is typically 1,000 rpm to 30,000 rpm, preferably 5,000 rpm to 20,000 rpm.

The dispersion time is not particularly limited, but it is typically 0.1 minutes to 5 minutes in case of a batch system.

The temperature during the dispersion is typically 0° C. to 150° C. (under pressure), preferably 40° C. to 98° C.

High temperature is preferable, as the viscosity of the dispersed element composed of the urea-modified polyester or prepolymer (A) is low, and dispersion is easily performed.

An amount of the aqueous medium for use is typically 50 parts by mass to 2,000 parts by mass, preferably 100 parts by mass to 1,000 parts by mass, relative to 100 parts by mass of a toner formulation (composition) containing the urea-modified polyester and the prepolymer (A).

When the amount thereof is smaller than 50 parts by mass, the dispersed state of the toner composition is not desirable, and toner particles having predetermined particle diameters cannot be obtained. When the amount thereof is greater than 2,000 parts by mass, it is not economical.

Moreover, a dispersant may be used, if necessary. Use of the dispersant is preferable, because a shape particle size distribution is attained, and dispersion is stabilized.

As for a process for synthesizing urea-modified polyester from prepolymer (A), amine (B) may be added before dispersing the toner components in an aqueous medium to proceed to a reaction, or amine (B) is added after dispersing the toner component in an aqueous medium to induce a reaction at an interface of a particle.

In this case, urea-modified polyester is generated preferentially at a surface of a toner produced, to thereby provide a concentration gradient within a particle of the toner.

Examples of the dispersant for emulsifying and dispersing the oil phase, in which the toner components are dispersed, in the liquid containing water, include; anionic surfactants such as alkyl benzene sulfonic acid salts, α-olefin sulfonic acid salts and phosphoric acid esters; amine salts such as alkyl amine salts, amino alcohol fatty acid derivatives, polyamine fatty acid derivatives and imidazoline; quaternary ammonium salt cationic surfactants such as alkyltrimethylammonium salts, dialkyldimethylammonium salts, alkyl dimethyl benzyl ammonium salts, pyridinium salts, alkyl isoquinolinium salts and benzethonium chloride; nonionic surfactants such as fatty acid amide derivatives and polyhydric alcohol derivatives; and amphoteric surfactants such as alanine, dodecyldi (aminoethyl)glycine, di(octylaminoethyl)glycine and N-alkyl-N,N-dimethylammonium betaine.

Moreover, use of a surfactant having a fluoroalkyl group can exhibit its effect with a small amount thereof.

Preferable examples of the fluoroalkyl group-containing anionic surfactant include C2-C10 fluoroalkyl carboxylic acid or a metal salt thereof, disodium perfluorooctane sulfonyl glutamate, sodium 3-[ω-fluoroalkyl(C6-C11)oxy)-1-alkyl(C3-C4) sulfonate, sodium 3-[ω-fluoroalkanoyl(C6-C8)-N-ethylamino]-1-propanesulfonate, fluoroalkyl(C11-C20) carboxylic acid or a metal salt thereof, perfluoroalkylcarboxylic acid(C7-C13) or a metal salt thereof, perfluoroalkyl(C4-C12)sulfonate or a metal salt thereof, perfluorooctanesulfonic acid diethanol amide, N-propyl-N-(2-hydroxyethyl)perfluorooctanesulfone amide, perfluoroalkyl(C6-C10)sulfoneamidepropyltrimethylammonium salt, a salt of perfluoroalkyl(C6-C10)-N-ethylsulfonylglycin and monoperfluoroalkyl(C6-C16) ethylphosphate.

Examples of product names of the products include: SURFLON S-111, S-112, S-113 (manufactured by Asahi Glass Co., Ltd.); FRORARD FC-93, FC-95, FC-98, FC-129 (manufactured by Sumitomo 3M Ltd.); UNIDYNE DS-101, DS-102 (manufactured by Daikin Industries, Ltd.); MEGAFACEF-110, F-120, F-113, F-191, F-812, F-833 (manufactured by DIC Corporation); EFTOP EF-102, 103, 104, 105, 112, 123A, 123B, 306A, 501, 201, 204 (manufactured by Tohchem Products Co., Ltd.); and FUTARGENT F-100, F150 (manufactured by NEOS COMPANY LIMITED).

Examples of the cationic surfactant include an aliphatic primary, secondary or tertiary amine acid containing a fluoroalkyl group, aliphatic quaternary ammonium salt such as perfluoroalkyl(C6-C10)sulfonic amide propyl trimethyl ammonium salt, benzalkonium salt, benzetonium chloride, pyridinium salt and imidazolinium salt. As for the cationic surfactant, commercial products can be used. Examples of product names of the products include: SURFLON S-121 (manufactured by Asahi Glass Co., Ltd.); FRORARD FC-135 (manufactured by Sumitomo 3M Ltd.); UNIDYNE DS-202 (manufactured by Daikin Industries, Ltd.); MEGAFACE F-150, F-824 (manufactured by DIC Corporation); EFTOP EF-132 (manufactured by Tohchem Products Co., Ltd.); and FUTARGENT F-300 (manufactured by NEOS COMPANY LIMITED).

Moreover, calcium phosphate, calcium carbonate, titanium oxide, colloidal silica, and hydroxyl apatite can be used as a water-insoluble compound dispersant.

Moreover, dispersed droplets may be stabilized with a polymer protective collide. Examples thereof include: acids such as acrylic acid, methacrylic acid, α-cyanoacrylic acid, α-cycanomethacrylic acid, itaconic acid, crotonic acid, fumaric acid, maleic acid, and maleic anhydride; a (meth) acryl monomer containing a hydroxyl group, such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid ester, diethylene glycol monoacrylic acid ester, glycerin monoacrylic acid ester, glycerin monomethacrylic acid ester, N-methylol acryl amide, and N-methylol methacryl amide; vinyl alcohol or ethers with vinyl alcohol, such as vinylmethyl ether, vinylethyl ether, and vinylpropyl ether; esters of vinyl alcohol with a compound containing a carboxyl group, such as vinyl acetate, vinyl propionate, and vinyl butyrate; acryl amides, such as acryl amide, methacryl amide, diacetone acryl amide or methylol compounds of the preceding amides; acid chlorides, such as acrylic acid chloride, and methacrylic acid chloride; a homopolymer or copolymer containing a nitrogen atom or its heterocycle, such as vinyl pyridine, vinyl pyrrolidone, vinyl imidazole, and ethylene imine; polyoxyethylenes, such as polyoxy ethylene, polyoxypropylene, polyoxy ethylene alkyl amine, polyoxypropylene alkyl amine, polyoxyethylene alkyl amide, polyoxypropylene alkyl amide, polyoxyethylene nonylphenyl ether, polyoxyethylene laurylphenyl ether, polyoxyethylene stearylphenyl ester, and polyoxyethylene nonylphenyl ester; and celluloses such as methyl cellulose, hydroxyethyl cellulose, and hydroxypropyl cellulose.

When an acid- or alkali-soluble compound (e.g., calcium phosphate) is used as a dispersion stabilizer, the calcium phosphate used is dissolved with an acid (e.g., hydrochloric acid), followed by washing with water, to thereby remove it from the formed particles.

Also, the calcium phosphate may be removed through enzymatic decomposition.

Alternatively, the dispersing agent used may remain on the surfaces of the toner particles. The dispersing agent is, however, preferably removed through washing after an elongation and/or crosslink reaction in terms of chargeability of the resulting toner.

In order to reduce the viscosity of the liquid containing the toner composition, a solvent capable of dissolving urea-modified polyester or prepolymer (A) can be used.

Use of the solvent is preferable, as the resulting toner has a sharp particle size distribution.

The solvent is preferably volatile, and having a boiling point of lower than 100° C., because it can be easily removed.

Examples of the solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone, and these may be used independently, or in combination. Among them, particularly preferred are an aromatic solvent, such as toluene, and xylene, and a halogenated hydrocarbon, such as methylene chloride, 1,2-dichloroethane, chloroform, and carbon tetrachloride.

An amount of the solvent used per 100 parts by mass of the prepolymer (A) is typically 0 parts by mass to 300 parts by mass, preferably 0 parts by mass to 100 parts by mass, and even more preferably 25 parts by mass to 70 parts by mass.

When the solvent is used, the solvent is removed by heating under normal pressure or reduced pressure after the elongation and/or crosslink reaction.

When a modified polyester reactive with active hydrogen is reacted with the amine (A) as a crosslinking agent and/or elongation agent, the duration for the elongation and/or crosslink reaction is selected depending on the reactivity due to the combination of the isocyanate group structure contained in the prepolymer (A) and the amine (B). The duration thereof is, however, typically 10 minutes to 40 hours, preferably 2 hours to 24 hours.

The reaction temperature is typically 0° C. to 150° C., preferably 40° C. to 98° C.

Moreover, a conventional catalyst is used, if necessary.

Specific examples thereof include dibutyl tin laurate, and dioctyl tin laurate.

In order to remove the organic solvent from the obtained emulsified dispersion liquid, the following method can be employed. The entire system is gradually heated and/or reduces its pressure, to thereby completely evaporate the organic solvent in droplets.

Alternatively, the emulsified dispersion liquid is sprayed in a dry atmosphere to completely remove the water-insoluble organic solvent contained in the droplets to form toner particles, at the same time, evaporating and removing the aqueous dispersant.

As for the dry atmosphere to which the emulsified dispersion liquid is sprayed, heated gas (e.g., air, nitrogen, carbon dioxide and combustion gas), particularly various air flow heated at the temperature equal to or higher than the highest boiling point of the solvent are generally used.

A treatment of a short period using a spray drier, belt dryer, or rotary kiln quality can sufficiently achieve the intended quality. The resultant may be further subjected to filtration.

In the case where the dispersed elements have a wide particle size distribution during the emulsifying and dispersing, and the resulting particles are washed and dried with keeping such particle size distribution, the particle size distribution can be adjusted to the intended particle size distribution by classification.

As the classification operation performed in the liquid, fine particles can be removed by means of cyclone, a decanter, or centrifugal separator.

Of course, the classification may be performed after attaining the particles as powder as a result of the drying. It is however more preferred that the classification be performed in the liquid in terms of the efficiency.

The collected unnecessary fine particles or coarse particles are return to the kneading process to use them for the formation of particles.

In this recycling operation, the fine particles or coarse particles may be in the wet state.

The used dispersant is preferably removed from the dispersion liquid as much as possible, and the removal of the dispersant is preferably performed at the same time as the operation of the classification.

By mixing the obtained and dried toner powder with other particles such as releasing agent particles, charge controlling particles, plasticizer particles, and colorant particles, or applying a mechanical impact to the powder mixture, the aforementioned other particles are fixed and fused on surfaces of the obtained composite particles, to thereby prevent the other particles from detaching from the surfaces of the composite particles.

A specific method for mixing or applying the impact include a method for applying impulse force to a mixture by a blade rotating at high speed, and a method for adding a mixture into a high-speed air flow and the speed of the flow is accelerated to thereby make the particles crash into other particles, or make the composite particles crush into an appropriate impact board.

Examples of the device for use include ANGMILL (product of Hosokawa Micron Corporation), an apparatus produced by modifying I-type mill (product of Nippon Pneumatic Mfg. Co., Ltd.) to reduce the pulverizing air pressure, a hybridization system (product of Nara Machinery Co., Ltd.), a kryptron system (product of Kawasaki Heavy Industries, Ltd.) and an automatic mortar.

(Two-Component Developer)

When the toner of the present invention is used for a two-component developer, the toner can be used by mixing with a magnetic carrier. As for the proportions of the toner and the carrier in the developer, the toner is preferably 1 part by mass to 10 parts by mass relative to 100 parts by mass of the carrier.

As for magnetic carrier, conventional magnetic carriers, such as an iron powder, ferrite powder, magnetite powder, and magnetic resin carrier having particle diameters of about 20 μm to about 200 μm, can be used.

As a coating material that may coat a surface of the carrier, an amino-based resin is use, and examples of which include a urea-formaldehyde resin, a melamine resin, a benzoguanamine resin, a urea resin, a polyamide resin, and an epoxy resin.

Other examples of the coating material include: a polyvinyl or polyvinylidene resin, such as an acryl resin, a polymethyl methacrylate resin, a polyacrylonitrile resin, a polyvinyl acetate resin, a polyvinyl alcohol resin, and a polyvinyl butyral resin; a polystyrene-based resin such as a polystyrene resin, and a styrene-acryl copolymer resin; a halogenated olefin resin, such as polyvinyl chloride; a polyester-based resin, such as a polyethylene terephthalate resin, and a polybutylene terephthalate; and others, such as a polycarbonate-based resin, a polyethylene resin, a polyvinyl fluoride resin, a polyvinylidene fluoride resin, a polytrifluoroethylene resin, a polyhexafluoropropylene resin, a copolymer of vinylidene fluoride and an acryl monomer, a copolymer of vinylidene fluoride and vinyl fluoride, a fluoroterpolymer (e.g., a terpolymer of tetrafluoroethylene, vinylidene fluoride, and a non-fluoride monomer), and a silicone resin.

Optionally, the coating resin may contain an electrically conductive powder therein.

As for the electrically conductive powder, for example, a metal powder, carbon black, titanium oxide, tin oxide, or zinc oxide can be used.

The electrically conductive powder preferably has the average particle diameter of 1 μm or smaller. When the average particle diameter thereof is larger than 1 μm, it may be difficult to control electric resistance.

The toner of the present invention may be used as a one-component magnetic or non-magnetic toner without a carrier.

The toner of the present invention can ensure the supply of the toner with a small residual amount thereof in a toner container, even when the toner is housed and used in the toner container composed of a flexible member capable of reducing its internal volume by 60% or more. Specifically, by charging the toner container composed of a flexible member capable of its internal volume by 60% or more with the toner of the present invention, the automatic feeding of the toner from the container to the developing unit is performed stably, occurrences of packing of the toner powder in the container is prevented after a storage period, and the residual amount of the toner powder can be reduced.

The toner of the present invention has low temperature fixing ability, and small particle diameter, but also having excellent flow characteristics without aggregation of the toner. Especially when a pump unit by which a flow formed by mixing a toner powder and air is prevented from back flow is used as a toner supplying unit connected with a toner storing unit, therefore, the flexible toner container automatically reduces its inner volume to change the outer shape of the container, which gives effect of loosening on the toner therein. Therefore, a residual amount of the toner in the toner container is effectively reduced.

The flowability of the toner is accelerated by blowing gas, such as air, into a toner container by a nozzle or the like, and passing the air with scattering the toner powder layer. As a result, toner feeding can be made more stable, and residual toner in the toner container is reduced even when a member for supplying a toner, such as an agitator, cannot be incorporated inside the toner container, as in the present invention.

One example of a method for supplying the toner from the toner container usable in the present invention will be described hereinafter.

In FIG. 1, air is sent to a toner container 23 from an air inflow unit 30. The air is blown into the toner container, and the blown air is passed with scattering a toner layer. Thereafter, the air blown into the toner container with the toner from the inside of the toner container passes through with scattering the toner layer, to thereby enhance flowability of the toner. As a result, supply of the toner is made more secure with preventing occurrences of crosslinks.

Application of moderate vibrations or impacts to the toner container, as well as sending the air, is effective for stably suctioning and transporting a toner having extremely poor flowability, and is effective for preventing crosslink of the toner, and stably transporting toner to a toner path. As for a specific method thereof, a conventional method for applying intermittent impacts using a cam and a lever, or applying vibrations using a motor or solenoid, may be used.

The powder pump unit 25 is, for example, preferably a suction type uniaxial eccentric screw pump (so-called Moinean pump). The configuration thereof include: a rotor formed in a shape of an eccentric screw with a rigid material, such as a metal; a stator formed of a rubber material and having a double flighted screw shape inside thereof, which is disposed by fixing; and a holder formed of a resinous material, covering the rotor and the stator and forming a transporting path for a powder.

As the rotor rates, strong self-suction force is generated in the pump so that the air flow containing the toner can be sanctioned. Moreover, use of an air pump in combination with the powder pump unit 25 accelerates flowability of the toner with the supplied air, and therefore transportation of the toner by the powder pump unit 25 is ensured.

As described above, the toner is supplied from the toner container 23 to the developing unit 10 with the air flow which is a transporting medium of the toner. The developing unit 10 contains a developing sleeve 11 disposed to face a photoconductor 1 serving as a latent image bearing member, and stirring screws 12, 13. The supplied toner is optimized for its toner density and charge amount in the developer circulated between the stirring screws 12, 13. Further, the developer is transferred to the developing sleeve 11, and the transferred developer is used for developing a latent electrostatic image formed on the photoconductor 1. Of course, the device as described is one example, and other developing devices and developing system can be also used.

Figure 2:
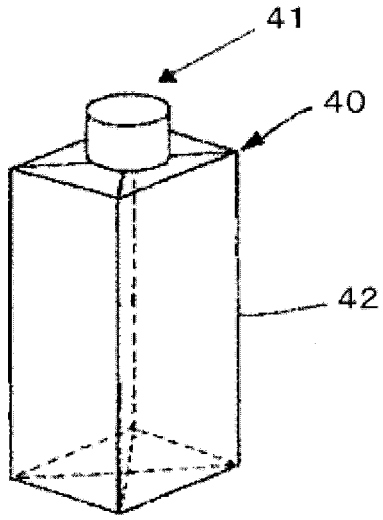
FIG. 2 is a schematic diagram illustrating one example of a toner container.
Figure 3:
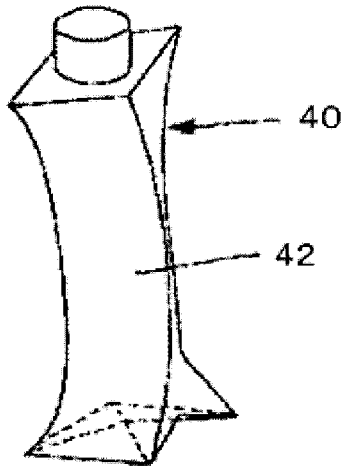
FIG. 3 is a schematic diagram of a toner container when a volume thereof is reduced.

The toner container usable in the present invention contains a bag portion composed of a flexible monolayer or laminate sheet, and a connecting portion. FIG. 2 depicts one example of the toner container, and FIG. 3 depicts a form of the toner container when its inner volume is reduced. The toner container 40 is composed of a rigid opening portion 41, and a flexible bag portion 42. As for the opening portion 41, a typical molding material, such as polyethylene, polypropylene, nylon, an ABS resin, and an NBS resin, can be used. As for the bag portion 42, a plastic film of polyethylene, polypropylene, polyester, or polyurethane, or paper can be used. In case of a plastic film, a thickness of about 0.05 mm to about 0.5 mm is preferable.

Figure 4:
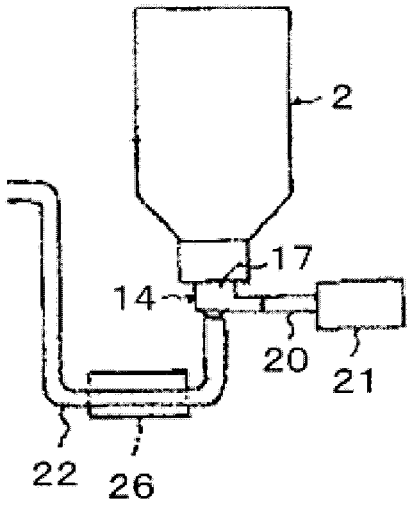
FIG. 4 is a schematic diagram of a toner supplying device equipped with a toner container, an air supplying device, and a powder pump.

FIG. 4 is a schematic diagram of a toner supplying device equipped with a toner container, an air supplying device, and a powder pump. In FIG. 4, 2 is a toner container, 14 is an air supply nozzle, 17 is an air nozzle, 20 is an air supply tube, 21 is an air pump, 22 is a toner feeding tube, and 26 is a powder pump.

When the toner container is flexible, the inner volume of the bag thereof is reduced as suction of the toner progresses, a toner packing caused due to local deformation of the bag-shaped toner container is prevented with the air introduced at the time when the inner volume of the toner container reduces, as well as enhancing the suction efficiency of the powder pump. Therefore, the stored toner is discharged without leaving the residual toner in the bag.

As illustrated in FIG. 1, the toner container 23 and the developing device 10 are connected with a tube 16. The tube 16 is for example a flexible tube having a diameter of 4 mm to 10 mm, and is preferably formed of a toner resistant rubber material, such as polyurethane, nitrile, EPDM, and silicone.

EXAMPLES

Examples of the present invention will be explained hereinafter, but Examples shall not be construed as limiting the scope of the present invention. Note that, "part(s)" described in Examples all denote "part(s) by mass."

In Examples, storage elastic modulus G', Tfb, and glass transition temperature of low molecular weight polyester were measured in the following manners. Moreover, number average molecular weight Mn, weight average molecular weight Mw, and acid value of the low molecular weight polyester were measured by the conventional measuring methods.

<Measuring Method of Storage Elastic Modulus G'>

The storage elastic modulus G' was measured by means of a viscoelasticity measuring device (rheometer) RDA-II (of TA Instruments Japan Inc. (previously Rheometric Scientific)).

Fixture: A parallel plate having a diameter of 7.9 mm was used.

Measuring sample: After heating and melting the toner, the melted toner was poured into a mold to thereby form a cylindrical sample having a diameter of about 8 mm, and height of 3 mm. The thus produced sample was used.

Measuring frequency: 1 Hz

Measuring temperature: 50° C. to 230° C.

Setting of measuring distortion: An initial value was set to 0.1%, and a measurement was carried out in an automatic measuring mode.

Correction of elongation of sample: It was adjusted in an automatic measuring mode.

<Measuring Method of Tfb>

The measurements of Ts and Tfb were carried out by means of a capillary rheometer (manufactured by Shimadzu Corporation) in accordance with the method described in JIS K72101.

A load of 10 kg/cm$^2$ was applied to a sample in the size of 1 cm$^3$ with a plunger with heating the sample at heating rate of 6° C./min, to thereby push the sample through a nozzle having a diameter of 0.5 mm, and a length of 1 mm, from which a plunger fall-temperature curve was drawn.

The thus obtained flow curve of the capillary rheometer gave the data as depicted in FIG. 5, from which each temperature could be read.

In FIG. 5, A is a measuring onset temperature, B is Ts (softening temperature), C is Tfb (flow onset temperature), D is 1/2 outflow temperature, and E is measuring endset temperature.

<Glass Transition Temperature Tg>

As for a device for measuring glass transition temperature (Tg), TG-DSC system TAS-100, manufactured by Rigaku Corporation, was used.

First, about 10 mg of a sample was placed in an aluminum sample container, and the container was set in an electric furnace.

After heating the sample from room temperature to 150° C. at the heating rate of 10° C./min, the sample was left to stand at 150° C. for 10 min. Then, the sample was cooled to room temperature, followed by leaving to stand for 10 min. The sample was again heated to 150° C. in the nitrogen atmosphere at the heating rate of 10° C./min, to thereby perform a measurement by DSC.

The glass transition temperature Tg was calculated from a contact point of a tangent line of an endothermic curve near the Tg, with a base line, using an analysis system in the TAS-100 system.

<Synthesis of Organic Particle Emulsion>

A reaction vessel equipped with a stirring bar and a thermometer was charged with 683 parts of water, 11 parts of a sodium salt of sulfuric acid ester of methacrylic acid-ethylene oxide adduct (ELEMINOL RS-30, manufactured by Sanyo Chemical Industries Ltd.), 83 parts of styrene, 83 parts of methacrylic acid, 110 parts of butyl acrylate, and 1 part of ammonium persulfate, and the resulting mixture was stirred for 15 minutes at 400 rpm to thereby obtain a white emulsion.

The emulsion was heated to the system temperature of 75° C., and was allowed to react for 5 hours.

To the resultant, 30 parts of a 1% ammonium persulfate aqueous solution was added, and the resulting mixture was matured for 5 hours at 75° C., to thereby obtain an aqueous dispersion liquid of a vinyl resin (a copolymer of styrene/methacrylic acid/sodium salt of sulfuric acid ester of methacrylic acid ethylene oxide adduct) [particle dispersion liquid 1].

The obtained [particle dispersion liquid 1] was subjected to the measurement by means of a particle size distribution measuring device (LA-920, manufactured by Horiba Ltd.), and the volume average particle diameter thereof as measured was 0.10 μm.

Part of the obtained [particle dispersion liquid 1] was dried to separate the resin component.

The resin component had Tg of 57° C., and weight average molecular weight of 121,000.

<Preparation of Aqueous Phase>

Water (990 parts), 80 parts of [particle dispersion liquid 1], 40 parts of a 48.5% aqueous solution of sodium dodecyldiphenyl ether disulfonate (ELEMINOL MON-7, manufactured by Sanyo Chemical Industries Ltd.), and 90 parts of ethyl acetate were mixed and stirred, to thereby obtain an opaque white liquid.

This liquid was used as [aqueous phase 1].

<Synthesis of Low Molecular Weight Polyester 1>

A reaction vessel equipped with a condenser, a stirrer and a nitrogen-introducing pipe was charged with 781 parts of bisphenol A propylene oxide 3 mol adduct, 218 parts of terephthalic acid, 48 parts of adipic acid, and 2 parts of dibutyl tin oxide, and the resulting mixture was allowed to react for 8 hours at 230° C. under atmospheric pressure, and was then further allowed to react for 5 hours under the reduced pressure of 10 mmHg to 15 mmHg. To the reaction vessel, 45 parts of trimellitic anhydride was added, and the mixture was allowed to react for 2 hours at 180° C. under the atmospheric pressure, to thereby obtain [low molecular weight polyester 1].

The [low molecular weight polyester 1] had the number average molecular weight of 2,500, weight average molecular weight of 6,700, Tg of 43° C., acid value of 25 mgKOH/g, resin softening coefficient of 0.166, G'(Tfb) of 9,800, and SP value of 11.1.

<Synthesis of Low Molecular Weight Polyester 2>

A reaction vessel equipped with a condenser, a stirrer and a nitrogen-introducing pipe was charged with 781 parts of bisphenol A ethylene oxide 3 mol adduct, 218 parts of terephthalic acid, 48 parts of adipic acid, and 2 parts of dibutyl tin oxide, the resulting mixture was allowed to react for 8 hours at 230° C. under the atmospheric pressure, and then was further reacted for 5 hours under the reduced pressure of 10 mmHg to 15 mmHg. To the reaction vessel, 45 parts of trimellitic anhydride, and the resulting mixture was allowed to react for 2 hours at 180° C. under the atmospheric pressure, to thereby obtain [low molecular weight polyester 2].

The [low molecular weight polyester 2] had the number average molecular weight of 1,400, weight average molecular weight of 4,500, Tg of 45° C., acid value of 15 mgKOH/g, resin softening coefficient of 0.183, G'(Tfb) of 7,000, and SP value of 10.9.

<Synthesis of Low Molecular Weight Polyester 3>

A reaction vessel equipped with a condenser, a stirrer and a nitrogen-introducing pipe was charged with 156 parts of bisphenol A ethylene oxide 3 mol adduct, 625 parts of bisphenol A propylene oxide 3 mol adduct, 218 parts of terephthalic acid, 48 parts of adipic acid, and 2 parts of dibutyl tin oxide, the resulting mixture was allowed to react for 8 hours at 230° C. under the atmospheric pressure, and then was further reacted for 5 hours under the reduced pressure of 10 mmHg to 15 mmHg.

To the reaction vessel, 45 parts of trimellitic anhydride was added, and the resulting mixture was allowed to react for 2 hours at 180° C., under the atmospheric pressure, to thereby obtain [low molecular weight polyester 3].

The [low molecular weight polyester 3] had the number average molecular weight of 1,500, weight average molecular weight of 2,500, Tg of 47° C., acid value of 19.6 mgKOH/g, resin softening coefficient of 0.192, G'(Tfb) of 6,500, and SP value of 11.1.

<Synthesis of Low Molecular Weight Polyester 4>

A reaction vessel equipped with a condenser, a stirrer and a nitrogen-introducing pipe was charged with 781 parts of bisphenol A propylene oxide 3 mol adduct, 218 parts of terephthalic acid, 48 parts of adipic acid, and 2 parts of dibutyl tin oxide, the resulting mixture was allowed to react for 8 hours at 230° C. under the atmospheric pressure, and then was further allowed to react for 5 hours under the reduced pressure of 10 mmHg to 15 mmHg. To the reaction vessel, 20 parts of trimellitic anhydride was added, and the resulting mixture was allowed to react for 2 hours at 180° C. under the atmospheric pressure, to thereby obtain [low molecular weight polyester 4].

The [low molecular weight polyester 4] had the number average molecular weight of 2,200, weight average molecular weight of 4,000, Tg of 48° C., acid value of 20.1 mgKOH/g, resin softening coefficient of 0.203, G'(Tfb) of 3,500, and SP value of 11.0.

<Synthesis of Low Molecular Weight Polyester 5>

A reaction vessel equipped with a condenser, a stirrer and a nitrogen-introducing pipe was charged with 781 parts of bisphenol A propylene oxide 3 mol adduct, 218 parts of terephthalic acid, 48 parts of adipic acid, and 2 parts of dibutyl tin oxide, the resulting mixture was allowed to react for 4 hours at 230° C. under the atmospheric pressure, and then was further allowed to react for 3 hours under the reduced pressure of 10 mmHg to 15 mmHg. To the reaction vessel, 45 parts of trimellitic anhydride was added, and the resulting mixture was allowed to react for 2 hours at 180° C. under the atmospheric pressure, to thereby obtain [low molecular weight polyester 5].

The [low molecular weight polyester 5] had the number average molecular weight of 3,500, weight average molecular weight of 4,500, Tg of 48° C., acid value of 18.5 mgKOH/g, resin softening coefficient of 0.220, G'(Tfb) of 4,000, and SP value of 11.15.

<Synthesis of Low Molecular Weight Polyester 6>

A reaction vessel equipped with a condenser, a stirrer and a nitrogen-introducing pipe was charged with 781 parts of bisphenol A propylene oxide 3 mol adduct, 218 parts of terephthalic acid, 48 parts of adipic acid, and 2 parts of dibutyl tin oxide, the resulting mixture was allowed to react for 9 hours at 230° C. under the atmospheric pressure, and then was further reacted for 3 hours under the reduced pressure of 10 mmHg to 15 mmHg. To the reaction vessel, 45 parts of trimellitic anhydride, and the resulting mixture was allowed to react for 2 hours at 180° C., under the atmospheric pressure, to thereby obtain [low molecular weight polyester 6].

The [low molecular weight polyester 6] had the number average molecular weight of 2,000, weight average molecular weight of 5,500, Tg of 42° C., acid value of 22.2 mgKOH/g, resin softening coefficient of 0.164, G'(Tfb) of 9,500, and SP value of 11.12.

<Synthesis of Low Molecular Weight Polyester 7>

A reaction vessel equipped with a condenser, a stirrer and a nitrogen-introducing pipe was charged with 781 parts of bisphenol A propylene oxide 3 mol adduct, 218 parts of terephthalic acid, 48 parts of adipic acid, and 2 parts of dibutyl tin oxide, the resulting mixture was allowed to react for 8 hours at 230° C. under the atmospheric pressure, and then was further reacted for 5 hours under the reduced pressure of 10 mmHg to 15 mmHg. To the reaction vessel, 55 parts of trimellitic anhydride was added, and the resulting mixture was allowed to react for 2 hours at 180° C., under the atmospheric pressure, to thereby obtain [low molecular weight polyester 7].

The [low molecular weight polyester 7] had the number average molecular weight of 3,500, weight average molecular weight of 6,500, Tg of 48° C., acid value of 18.0 mgKOH/g, resin softening coefficient of 0.167, G'(Tfb) of 12,000, and SP value of 11.22.

<Synthesis of Low Molecular Weight Polyester 8>

A reaction vessel equipped with a condenser, a stirrer and a nitrogen-introducing pipe was charged with 781 parts of bisphenol A propylene oxide 3 mol adduct, 198 parts of terephthalic acid, 58 parts of adipic acid, and 2 parts of dibutyl tin oxide, the resulting mixture was allowed to react for 8 hours at 230° C. under the atmospheric pressure, and then was further reacted for 5 hours under the reduced pressure of 10 mmHg to 15 mmHg. To the reaction vessel, 55 parts of trimellitic anhydride was added, and the resulting mixture was allowed to react for 2 hours at 180° C., under the atmospheric pressure, to thereby obtain [low molecular weight polyester 8].

The [low molecular weight polyester 8] had the number average molecular weight of 4,600, weight average molecular weight of 7,000, Tg of 50° C., acid value of 15.0 mgKOH/g, resin softening coefficient of 0.158, G'(Tfb) of 12,000, and SP value of 11.18.

<Synthesis of Low Molecular Weight Polyester 9>

A reaction vessel equipped with a condenser, a stirrer and a nitrogen-introducing pipe was charged with 1,293 parts of bisphenol A propylene oxide 3 mol adduct, 324 parts of terephthalic acid, 88 parts of adipic acid, 6 parts of dibutyl tin oxide, the resulting mixture was allowed to react for 13 hours at 230° C. under the atmospheric pressure, and then was further allowed to react for 7 hours under the reduced pressure of 10 mmHg to 15 mmHg. To the reaction vessel, 77 parts of trimellitic anhydride was added, and the resulting mixture was allowed to react for 4 hours at 180° C. under the atmospheric pressure, to thereby obtain [low molecular weight polyester 9].

The [low molecular weight polyester 9] had the number average molecular weight of 9,600, weight average molecular weight of 28,000, Tg of 43° C., acid value of 12.2 mgKOH/g, T1 of 62.8° C., T2 of 75.1° C., resin softening coefficient of 0.374, G'(Tfb) of 6,800, and SP value of 11.02.

(Synthesis of Low Molecular Weight Polyester 10)

A reaction vessel equipped with a condenser, a stirrer and a nitrogen-introducing pipe was charged with 882 parts of bisphenol A propylene oxide 3 mol adduct, 192 parts of terephthalic acid, 54 parts of adipic acid, and 2 parts of dibutyl tin oxide, the resulting mixture was allowed to react for 13 hours at 230° C. under the atmospheric pressure, and then was further allowed to react for 7 hours under the reduced pressure of 10 mmHg to 15 mmHg. To the reaction vessel, 55 parts of trimellitic anhydride was added, and the resulting mixture was allowed to react for 2 hours at 180° C. under the atmospheric pressure to thereby obtain [low molecular weight polyester 10].

The [low molecular weight polyester 10] had the number average molecular weight of 3,200, weight average molecular weight of 9,500, Tg of 47° C., acid value of 19.0 mgKOH/g, T1 of 57.2° C., T2 of 84.8° C., G'(Tfb) of 9,600, resin softening coefficient of 0.167, and SP value of 10.96.

<Synthesis of Low Molecular Weight Polyester 11>

A reaction vessel equipped with a condenser, a stirrer and a nitrogen-introducing pipe was charged with 781 parts of bisphenol A propylene oxide 3 mol adduct, 218 parts of terephthalic acid, 48 parts of adipic acid, and 2 parts of dibutyl tin oxide, the resulting mixture was allowed to react for 8 hours at 230° C. under the atmospheric pressure, and then was further allowed to react for 5 hours under the reduced pressure of 10 mmHg to 15 mmHg. To the reaction vessel, 65 parts of trimellitic anhydride was added, and the resulting mixture was allowed to react for 4 hours at 180° C., under the atmospheric pressure, to thereby obtain [low molecular weight polyester 11].

The [low molecular weight polyester 11] had the number average molecular weight of 4,200, weight average molecular weight of 8,200, Tg of 52° C., acid value of 18.0 mgKOH/g, T1 of 61.2° C., T2 of 74.1° C., resin softening coefficient of 0.357, G'(Tfb) of 6,600, and SP value of 11.3.

<Synthesis of Low Molecular Weight Polyester 12>

A reaction vessel equipped with a condenser, a stirrer and a nitrogen-introducing pipe was charged with 781 parts of bisphenol A propylene oxide 3 mol adduct, 218 parts of terephthalic acid, 48 parts of adipic acid, and 2 parts of dibutyl tin oxide, the resulting mixture was allowed to react for 8 hours at 230° C. under the atmospheric pressure, and then was further allowed to react for 5 hours under the reduced pressure of 10 mmHg to 15 mmHg. To the reaction vessel, 65 parts of trimellitic anhydride was added, and the resulting mixture was allowed to react for 4 hours at 180° C. under the atmospheric pressure, to thereby obtain [low molecular weight polyester 12].

The [low molecular weight polyester 12] had the number average molecular weight of 2,600, weight average molecular weight of 6,400, Tg of 48° C., acid value of 20.2 mgKOH/g, T1 of 59.2° C., T2 of 68.3° C., resin softening coefficient of 0.506, G'(Tfb) of 4,500, and SP value of 11.1.

<Synthesis of Low Molecular Weight Polyester 13>

A reaction vessel equipped with a condenser, a stirrer and a nitrogen-introducing pipe was charged with 781 parts of bisphenol A ethylene oxide 3 mol adduct, 218 parts of terephthalic acid, 52 parts of fumaric acid, and 2 parts of dibutyl tin oxide, the resulting mixture was allowed to react for 8 hours at 230° C. under the atmospheric pressure, and then was further reacted for 5 hours under the reduced pressure of 10 mmHg to 15 mmHg. To the reaction vessel, 45 parts of trimellitic anhydride was added, and the resulting mixture was allowed to react for 2 hours at 180° C. under the atmospheric pressure, to thereby obtain [low molecular weight polyester 13].

The [low molecular weight polyester 13] had the number average molecular weight of 3,200, weight average molecular weight of 7,200, Tg of 44° C., acid value of 20.2 mgKOH/g, resin softening coefficient of 0.163, G'(Tfb) of 9,600, and SP value of 11.02.

<Synthesis of Low Molecular Weight Polyester 14>

A reaction vessel equipped with a condenser, a stirrer and a nitrogen-introducing pipe was charged with 1,650 parts of bisphenol A ethylene oxide 3 mol adduct, 483 parts of terephthalic acid, 150 parts of adipic acid, and 18 parts of dibutyl tin oxide, the resulting mixture was allowed to react for 10 hours at 230° C. under the atmospheric pressure, and then was further allowed to react for 9 hours under the reduced pressure of 10 mmHg to 15 mmHg. To the reaction vessel, 92 parts of trimellitic anhydride was added, and the resulting mixture was allowed to react for 2 hours at 180° C. under the atmospheric pressure, to thereby obtain [low molecular weight polyester 14].

The [low molecular weight polyester 14] had the number average molecular weight of 16,300, weight average molecular weight of 48,600, Tg of 52° C., acid value of 18.0 mgKOH/g, resin softening coefficient of 0.167, G'(Tfb) of 10,600, and SP value of 11.02.

<Synthesis of Low Molecular Weight Polyester 15>

A reaction vessel equipped with a condenser, a stirrer and a nitrogen-introducing pipe was charged with 882 parts of bisphenol A propylene oxide 3 mol adduct, 192 parts of terephthalic acid, 64 parts of fumaric acid, and 2 parts of dibutyl tin oxide, the resulting mixture was allowed to react for 13 hours at 230° C. under the atmospheric pressure, and then was further allowed to react for 7 hours under the reduced pressure of 10 mmHg to 15 mmHg. To the reaction vessel, 55 parts of trimellitic anhydride was added, and the resulting mixture was allowed to react for 2 hours at 180° C., under the atmospheric pressure, to thereby obtain [low molecular weight polyester 15].

The [low molecular weight polyester 15] had the number average molecular weight of 4,200, weight average molecular weight of 9,300, Tg of 50° C., acid value of 13.0 mgKOH/g, resin softening coefficient of 0.349, G'(Tfb) of 9,600, and SP value of 10.92.

<Synthesis of Low Molecular Weight Polyester 16>

A reaction vessel equipped with a condenser, a stirrer and a nitrogen-introducing pipe was charged with 781 parts of bisphenol A propylene oxide 3 mol adduct, 218 parts of terephthalic acid, 48 parts of adipic acid, and 2 parts of dibutyl tin oxide, the resulting mixture was allowed to react for 4 hours at 230° C. under the atmospheric pressure, and then was further allowed to react for 3 hours under the reduced pressure of 10 mmHg to 15 mmHg. To the reaction vessel, 77 parts of trimellitic anhydride was added, and the resulting mixture was allowed to react for 6 hours at 180° C., under the atmospheric pressure to thereby obtain [low molecular weight polyester 16].

The [low molecular weight polyester 16] had the number average molecular weight of 2,800, weight average molecular weight of 8,100, Tg of 52° C., acid value of 16.0 mgKOH/g, T1 of 62.8° C., T2 of 75.1° C., resin softening coefficient of 0.374, G'(Tfb) of 9,600, and SP value of 11.3.

The physical properties of low molecular weight polyesters 1 to 16 are presented in Table 1.

TABLE 1

| No. | Mn | Mw | Tg | Acid value | Resin softening coefficient | G (Tfb) | SP value |
|---|---|---|---|---|---|---|---|
| 1 | 2,500 | 6,700 | 43 | 25 | 0.166 | 9,800 | 11.1 |
| 2 | 1,400 | 4,500 | 45 | 15 | 0.183 | 7,000 | 10.9 |
| 3 | 1,500 | 2,500 | 47 | 19.6 | 0.192 | 6,500 | 11.1 |
| 4 | 2,200 | 4,000 | 48 | 20.1 | 0.203 | 3,500 | 11.0 |
| 5 | 3,500 | 4,500 | 48 | 18.5 | 0.220 | 4,000 | 11.15 |
| 6 | 2,000 | 5,500 | 42 | 22.2 | 0.164 | 9,500 | 11.12 |
| 7 | 3,500 | 6,500 | 48 | 18 | 0.167 | 12,000 | 11.22 |
| 8 | 4,600 | 7,000 | 50 | 15 | 0.158 | 12,000 | 11.18 |
| 9 | 9,600 | 28,000 | 43 | 12.2 | 0.374 | 6,800 | 11.02 |
| 10 | 3,200 | 9,500 | 47 | 19.0 | 0.167 | 9,600 | 10.96 |
| 11 | 4,200 | 8,200 | 52 | 18 | 0.357 | 6,600 | 11.3 |
| 12 | 2,600 | 6,400 | 48 | 20.2 | 0.506 | 4,500 | 11.1 |
| 13 | 3,200 | 7,200 | 44 | 20.2 | 0.163 | 9,600 | 11.02 |
| 14 | 16,300 | 48,600 | 52 | 18.0 | 0.167 | 10,600 | 11.02 |
| 15 | 4,200 | 9,300 | 50 | 13 | 0.349 | 9,600 | 10.92 |
| 16 | 2,800 | 8,100 | 52 | 16 | 0.374 | 9,600 | 11.3 |

<Synthesis of Crystalline Polyester 1>

A 5 L four neck flask equipped with a nitrogen-introducing pipe, a drainpipe, a stirrer and a thermocouple was charged with 1,260 g of 1,6-hexandiol, 120 g of ethylene glycol, 1,400 g of fumaric acid, 350 g of trimellitic anhydride, 3.5 g of octyl tin oxide, and 1.5 g of hydroquinone. The resulting mixture was allowed to react for 5 hours at 160° C., then heated and reacted at 200° C. for 1 hour, and further reacted for 1 hour at 8.3 kPa, to thereby obtain crystalline polyester (1).

The crystalline polyester (1) had the melting point of 89° C., and the SP value of 9.9.

<Synthesis of Crystalline Polyester 2>

A 5 L four neck flask equipped with a nitrogen-introducing pipe, a drainpipe, a stirrer and a thermocouple was charged with 1,260 g of 1,4-butanediol, 120 g of ethylene glycol, 1,400 g of stearic acid, 350 g of trimellitic anhydride, 3.5 g of octyl tin oxide, and 1.5 g of hydroquinone. The resulting mixture was allowed to react for 5 hours at 160° C., then heated and reacted at 200° C. for 1 hour, and further reacted for 1 hour at 8.3 kPa, to thereby obtain crystalline polyester (2).

The crystalline polyester (2) had the melting point of 89° C., and the SP value of 9.5.

<Synthesis of Crystalline Polyester 3>

A 5 L four neck flask equipped with a nitrogen-introducing pipe, a drainpipe, a stirrer and a thermocouple was charged with 1,260 g of 1,4-butanediol, 120 g of ethylene glycol, 1,400 g of fumaric acid, 350 g of trimellitic anhydride, 3.5 g of octyl tin oxide, and 1.5 g of hydroquinone. The resulting mixture was allowed to react for 5 hours at 160° C., then heated and reacted at 200° C. for 1 hour, and further reacted for 1 hour at 8.3 kPa, to thereby obtain crystalline polyester (3).

The crystalline polyester (3) had the melting point of 87° C., and the SP value of 9.4.

<Synthesis of Prepolymer>

A reaction vessel equipped with a condenser, a stirrer and a nitrogen-introducing pipe was charged with 682 parts of a bisphenol A ethylene oxide 2 mol adduct, 81 parts of a bisphenol A propylene oxide 2 mol adduct, 283 parts of terephthalic acid, 22 parts of trimellitic anhydride, and 2 parts of dibutyl tin oxide. The resulting mixture was allowed to react for 8 hours at 230° C. under atmospheric pressure, followed by reacting for 5 hours at 10 mmHg to 15 mmHg, to thereby obtain [intermediate polyester 1].

The [intermediate polyester 1] had the number average molecular weight of 2,100, the weight average molecular weight of 9,500, Tg of 55° C., acid value of 0.5 mgKOH/g, and hydroxyl value of 49 mgKOH/g.

Next, a reaction vessel equipped with a condenser, a stirrer and a nitrogen-introducing pipe was charged with 411 parts of the [intermediate polyester 1], 89 parts of isophorone diisocyanate, and 500 parts of ethyl acetate, and the resulting mixture was allowed to react for 5 hours at 100° C., to thereby obtain [prepolymer 1].

The [prepolymer 1] had a free isocyanate rate (% by mass) of 1.53%.

<Synthesis of Ketimine>

A reaction vessel equipped with a stirring bar and a thermometer was charged with 170 parts of isophorone diamine, 75 parts of methylethylketone, and the resulting mixture was allowed to react for 5 hours at 50° C., to thereby obtain [ketimine compound 1].

The [ketimine compound 1] had an amine value of 418.

<Synthesis of Master Batch>

Fourty parts of carbon black (REGAL 400R, manufactured by Cabot Corporation), 60 parts of a binder resin (a polyester resin, RS-801, manufactured by Sanyo Chemical Industries Ltd., acid value: 10, weight average molecular weight Mw: 20,000, Tg: 64° C.), and 30 parts of water were mixed by means of HENSCHEL MIXER, to thereby obtain a mixture in which water was penetrated into pigment aggregates.

The resultant was kneaded for 45 minutes by means of a two roll mill a roll surface temperature of which was set to 130° C. The resulting kneaded product was pulverized by means of a pulverizer to give particles having diameters of 1 mm, to thereby obtain [master batch 1].

Example 1

<Production of Toner>

—Production of Oil Phase—

A vessel equipped with a stirring bar and a thermometer was charged with 378 parts of [low molecular weight polyester 1], 110 parts of carnauba wax, 220 parts of [crystalline polyester 1], and 947 parts of ethyl acetate, and the resulting mixture was heated to 80° C. with stirring. The temperature was kept at 80° C. for 5 hours, followed by cooling to 30° C. over 1 hour, to thereby obtain [raw material dissolution liquid 1].

The [raw material dissolution liquid 1] (1,324 parts) was transferred to a vessel, and was dispersed by means of a bead mill (ULTRA VISCOMILL, product of AIMEX CO., Ltd.) under the conditions: a liquid feed rate of 1 kg/hr, disc circumferential velocity of 6 m/s, 0.5 mm-zirconia beads packed to 80% by volume, and 3 passes, to thereby prepare a raw material dispersion liquid (1).

Next, [master batch 1] was added to [raw material dispersion liquid 1], and the resulting mixture was dispersed once by means of the bead mill under the aforementioned conditions, to thereby obtain [oil phase dispersion liquid 1].

The obtained [oil phase dispersion liquid 1] had the solid content (130° C., 30 min.) of 50%.

(Emulsification, Deformation, and Removal of Solvent)

A vessel was charged with 648 parts of [oil phase dispersion liquid 1], a 154 parts of [prepolymer 1], and 6.6 parts of [ketimine compound 1], and the resulting mixture was mixed for 1 minutes by means of TK homomixer (manufactured by Tokushukika Kogyo Co., Ltd.) at 5,000 rpm. Thereafter, 1,200 parts of [aqueous phase 1] was added to the vessel, and the mixture was mixed for 3 minutes by TK homomixer at 13,000 rpm, to thereby obtain [emulsification slurry 1].

A vessel equipped with a stirrer and a thermometer was charged with [emulsified slurry 1] and the [emulsified slurry 1] was left to stand for 1 hour at 15° C., followed by removing the solvent therein at 30° C. for 1 hour, to thereby obtain [dispersion slurry 1].

The obtained [dispersion slurry 1] had the volume average particle diameter of 5.95 μm, and number average particle diameter of 5.45 μm (measured by Multisizer II).

(Washing and Drying)

After subjecting 100 parts of [emulsified slurry 1] to filtration under the reduced pressure, the resultant was subjected twice to a series of treatments (i) to (iv) described below, to thereby produce [filtration cake 1]

(i): ion-exchanged water (100 parts) was added to the filtration cake, the mixture was mixed by means of TK homomixer (at 12,000 rpm for 10 minutes), followed by filtration.

(ii): to the filtration cake of (i), 100 parts of a 10% sodium hydroxide aqueous solution was added, and the mixture was mixed by means of TH homomixer (at 12,000 rpm for 30 minutes) with application of ultrasonic vibrations, followed by filtration under the reduced pressure. This ultrasonic wave alkali washing was performed a few times (ultrasonic wave alkali washing: twice).

(iii): to the filtration cake of (ii), 100 parts of 10% hydrochloric acid was added, and the mixture was mixed by means of TK homomixer (at 12,000 rpm for 10 minutes), followed by filtration.

(iv): to the filtration cake of (iii), 300 parts of ion-exchanged water was added, and the mixture was mixed by means of TK homomixer (at 12,000 rpm for 10 minutes), followed by filtration.

The obtained [filtration cake 1] was dried with an air-circulating drier at 45° C. for 48 hours, and then was caused to pass through a sieve with a mesh size of 75 to thereby prepare Toner 1.

Example 2

Toner 2 was obtained in the same manner as in Example 1, provided that [low molecular weight polyester 1] was replaced with [low molecular weight polyester 2].

Example 3

Toner 3 was obtained in the same manner as in Example 1, provided that [low molecular weight polyester 1] was replaced with [low molecular weight polyester 3].

Example 4

Toner 4 was obtained in the same manner as in Example 1, provided that [low molecular weight polyester 1] was replaced with [low molecular weight polyester 4].

Example 5

Toner 5 was obtained in the same manner as in Example 1, provided that [low molecular weight polyester 1] was replaced with [low molecular weight polyester 5].

Comparative Example 1

Toner 6 was obtained in the same manner as in Example 1, provided that [low molecular weight polyester 1] was replaced with [low molecular weight polyester 6].

Comparative Example 2

Toner 7 was obtained in the same manner as in Example 1, provided that [low molecular weight polyester 1] was replaced with [low molecular weight polyester 7].

Comparative Example 3

Toner 8 was obtained in the same manner as in Example 1, provided that [low molecular weight polyester 1] was obtained in the same manner as in [low molecular weight polyester 8].

To 100 parts of obtained each toner, 0.7 parts of hydrophobic silica, and 0.3 parts of hydrophobic titanium oxide were mixed by means of HENSCHEL MIXER.

Physical properties of the obtained toner are depicted in Table 2.

—Production of Developer—

Prepared was a developer containing 5% by mass of a toner which had been treated with an external additive, and 95% by mass of a copper-zinc ferrite carrier coated with a silicone, and having the average particle diameter of 40 μm. An image forming apparatus (imagio Neo450, manufactured by Ricoh Company Limited) capable of outputting 45 prints of A4 size per minute was used to perform continuous printing, and the result was evaluated in the following criteria. The results are presented in Table 2.

<Volume Average Particle Diameter Dv, Number Average Particle Diameter Dn, and Particle Size Distribution (Dv/Dn) of Toner>

The volume average particle diameter Dv, number average particle diameter Dn, and particle size distribution (Dv/Dn) of the toner was measured by means of a particle sizer, Coulter Counter TAIL manufactured by Coulter Electronics, with an aperture diameter of 100 μm.

<Average Circularity of Toner>

As for a measuring method of the average circularity of the toner, an appropriate method is a method using an optical detecting zone where a suspension liquid containing particles is passed through a detection zone of an imaging section on a flat plate to optically detect a particle image by a CCD camera and to analyze the image.

A circularity is a value obtained by dividing a boundary length of a circle corresponding to and having the same area to the projected area obtained in the aforementioned method by a circumferential length of an actual particle.

This value was measured as an average circularity by means of a flow particle imaging analyzer FPIA-2100 (manufactured by Toa Medical Electronics Co., Ltd.).

As for a specific measuring method, a measurement was performed as follows. To 100 mL to 150 mL of water in a vessel from which solids of impurities had been removed in advance, 0.1 mL to 0.5 mL of a surfactant (alkyl benzene sulfonate) was added as a dispersant, followed by adding about 0.1 g to about 0.5 g of a measuring sample.

A suspension liquid in which the sample was dispersed was subjected to a dispersion treatment for about 1 minute to about 3 minutes by means of an ultrasonic disperser to give a dispersion concentration of 3000 particles per microliter to 10,000 particles per microliter, with which a shape of a toner was measured by means of the aforementioned device.

<Fixing Ability (Minimum Fixing Temperature, Fixing Width)>

Imagio Neo450 manufactured by Ricoh Company Limited was adjusted to develop a solid image with 1.0 mg/cm$^2$±0.1 mg/cm$^2$ of a toner on transfer paper including plain paper and a card board (Type 6200 manufactured by Ricoh Company Limited, and photocopy printing sheet <135> manufactured by NBS Ricoh), and was adjusted so that the temperature of the fixing belt was variable. In such manner, the temperature at which offset did not occur was measured on the plain paper, and the minimum fixing temperature was measured on the card board.

The minimum fixing temperature was determined with temperature of the fixing roller at which the obtained fixed image had 70% or more in the residual ratio of the image density after rubbing the fixed image with a pad, and the low temperature fixing ability was evaluated based on the following criteria.

[Evaluation Criteria]

A: the minimum fixing temperature was lower than 140° C.

B: the minimum fixing temperature was 140° C. to 150° C.

C: the minimum fixing temperature was higher than 150° C.

Moreover, fixing was performed with varying the temperature of the heating roller, to thereby measure an occurrence of hot offset.

[Evaluation Criteria]

A: a difference (fixing width) between the minimum fixing temperature and offset occurring temperature was 50° C. or more.

B: a difference (fixing width) between the minimum fixing temperature and offset occurring temperature was 30° C. or more, but less than 50° C.

C: a difference (fixing width) between the minimum fixing temperature and offset occurring temperature was less than 30° C.

The toner satisfying the fixable temperature range of 135° C. to 200° C. in this method can give stable fixing images, without being influenced by deterioration of the fixing device, and operation conditions of a user.

<Shelf Stability>

A toner sample (20 g) was placed in a 20 mL glass bottle, and the bottle was left to stand in a thermostat of 60° C. for 4 hours. Thereafter, a penetration degree was measured in accordance with a penetration test (JIS K2235-1991), and was evaluated based on the following criteria.

[Evaluation Criteria]

A: 10 mm or more

B: 9.9 mm to 5 mm

C, 4.9 mm to 0 mm

<Cleaning Property>

The residual toner after transfer, which had been remained on the photoconductor passed the cleaning step was transferred onto white paper using a scotch tape (manufactured by Sumitomo 3M Limited). The transferred residual toner was measured by means of Macbeth reflection densitometer RD514 to determine a difference with a blank, and the result was evaluated based on the following criteria.

[Evaluation Criteria]

I: a difference with a blank was 0.01 or less.

II: a difference with a blank was more than 0.01.

TABLE 2

| | Toner | Resin softening coefficient A | G' (Tfb) | Dv | Dn |
|---|---|---|---|---|---|
| Ex. 1 | Toner 1 | 0.166 | 9,800 | 5.53 | 4.57 |
| Ex. 2 | Toner 2 | 0.183 | 7,000 | 6.02 | 5.15 |
| Ex. 3 | Toner 3 | 0.192 | 6,500 | 5.31 | 4.50 |
| Ex. 4 | Toner 4 | 0.203 | 3,500 | 4.89 | 4.01 |
| Ex. 5 | Toner 5 | 0.22 | 4,000 | 7.02 | 5.40 |
| Comp. Ex. 1 | Toner 6 | 0.164 | 9,500 | 6.32 | 5.14 |
| Comp. Ex. 2 | Toner 7 | 0.167 | 12,000 | 5.8 | 4.53 |
| Comp. Ex. 3 | Toner 8 | 0.158 | 12,000 | 5.12 | 4.34 |

| | Dv/Dn | Circularity | Fixing width | Storage stability | Cleaning properties | Total evaluation |
|---|---|---|---|---|---|---|
| Ex. 1 | 1.21 | 0.95 | B | A | I | A |
| Ex. 2 | 1.17 | 0.96 | A | A | I | A |
| Ex. 3 | 1.18 | 0.98 | A | A | I | A |
| Ex. 4 | 1.22 | 0.96 | A | B | I | A |
| Ex. 5 | 1.3 | 0.94 | A | B | I | A |
| Comp. Ex. 1 | 1.23 | 0.94 | C | A | I | C |
| Comp. Ex. 2 | 1.28 | 0.95 | C | A | I | C |
| Comp. Ex. 3 | 1.18 | 0.96 | C | A | I | C |

Example 6

Toner 9 was obtained in the same manner as in Example 1, provided that [emulsification, deformation, and removal of solvent] of Example 1 was changed as described below, and the [low molecular weight polyester 1] was replaced with [low molecular weight polyester 9].

[Emulsification, Deformation, and Removal of Solvent]

A vessel was charged with 800 parts of [oil phase dispersion liquid 1], and 6.6 parts of [ketimine compound 1], and the mixture was mixed for 1 minutes at 5,000 rpm by means of a TK homomixer (manufactured by Tokushukika Kogyo Co., Ltd.). Thereafter, 1,200 parts of [aqueous phase 1] was added to the vessel, and the resulting mixture was mixed for 3 minutes at 13,000 rpm by means of the TK homomixer, to thereby obtain [emulsified slurry 1].

A vessel equipped with a stirrer and a thermometer was charged with [emulsified slurry 1], and after leaving to stand for 1 hour at 15° C., the solvent was removed from [emulsified slurry 1] at 30° C. for 1 hour, to thereby obtain [dispersion slurry 1].

The obtained [dispersion slurry 1] had the volume average particle diameter of 5.95 μm, and number average particle diameter of 5.45 μm (measured by Multisizer II).

Example 7

Toner 10 was obtained in the same manner as in Example 6, provided that [low molecular weight polyester 9] was replaced with [low molecular weight polyester 10].

Example 8

Toner 11 was obtained in the same manner as in Example 6, provided that [low molecular weight polyester 9] was replaced with [low molecular weight polyester 11], and [crystalline polyester 1] was replaced with [crystalline polyester 2].

Example 9

Toner 12 was obtained in the same manner as in Example 1, provided that [low molecular weight polyester 1] was replaced with [low molecular weight polyester 12].

Example 10

Toner 13 was obtained in the same manner as in Example 9, provided that the amount of [prepolymer 1] was changed to 288 parts.

Comparative Example 4

Toner 14 was obtained in the same manner as in Example 6, provided that [low molecular weight polyester 9] was replaced with [low molecular weight polyester 13].

Comparative Example 5

Toner 15 was obtained in the same manner as in Example 6, provided that [low molecular weight polyester 9] was replaced with [low molecular weight polyester 14].

Example 11

Toner 16 was obtained in the same manner as in Example 9, provided that [low molecular weight polyester 12] was replaced with [low molecular weight polyester 15].

Example 12

Toner 17 was obtained in the same manner as in Example 9, provided that [low molecular weight polyester 12] was replaced with [low molecular weight polyester 16], and [crystalline polyester 1] was replaced with [crystalline polyester 3].

To each of the obtained toners (100 parts), 0.7 parts of hydrophobic silica and 0.3 parts of hydrophobic titanium oxide were added and mixed by means of HENSCHEL MIXER. Physical properties of the obtained toner are depicted in Table 3.

—Production of Developer—

A developer composed of 5% by mass of the toner which was treated with an external additive, and 95% by mass of a copper-zinc ferrite carrier having the average particle diameter of 40 μm was prepared. A continuous printing was carried out by means of an image forming apparatus (imagioNeo450, manufactured by Ricoh Company Limited) capable of printing on 45 A4-size sheets per minute, and the resulting prints were evaluated in terms of low temperature fixing ability and storage stability based on the following criteria. Further, evaluation was performed on toner spent based on the following criteria. The results are presented in Table 3.

<Toner Spent>

A chart having an image area of 20% was output on 200,000 sheets by means of a tandem color image forming apparatus (imagio Neo450, manufactured by Ricoh Company Limited) by controlling a toner density to give an image density of 1.4 mg/cm$^2$±0.2 mg/cm$^2$. Thereafter, variation in the amount of the electric charge of the developer (reduction in the amount of the electric charge (μc/g) after running to output 200,000 sheets/the amount of the electric charge before running), which compared between the initial value before the output and the value after the output. The result was evaluated based on the following criteria. Note that, the amount of the electric charge was measured by a blow-off method.

[Evaluation Criteria]

I: less than 15%

II: 15% or more, but less than 30%

III: 30% or more, but less than 50%

IV: 50% or more

TABLE 3

| | Toner No. | Crystalline PES No. | SP (a) | Low molecular weight PES No. | Resin softening coefficient (A) | G' (Tfb) | SP (b) | SP (a) − SP (b) |
|---|---|---|---|---|---|---|---|---|
| Ex. 6 | 9 | 1 | 9.9 | 9 | 0.374 | 6,800 | 11.02 | 1.12 |
| Ex. 7 | 10 | 1 | 9.9 | 10 | 0.167 | 9,600 | 10.96 | 1.06 |
| Ex. 8 | 11 | 2 | 9.5 | 11 | 0.357 | 6,600 | 11.3 | 1.8 |
| Ex. 9 | 12 | 1 | 9.9 | 12 | 0.506 | 4,500 | 11.1 | 1.2 |
| Ex. 10 | 13 | 1 | 9.9 | 12 | 0.506 | 4,500 | 11.1 | 1.2 |
| Comp. Ex. 4 | 14 | 1 | 9.9 | 13 | 0.163 | 9,600 | 11.02 | 1.12 |
| Comp. Ex. 5 | 15 | 1 | 9.9 | 14 | 0.167 | 10,600 | 11.02 | 1.12 |
| Ex. 11 | 16 | 1 | 9.9 | 15 | 0.349 | 9,600 | 10.92 | 1.02 |
| Ex. 12 | 17 | 3 | 9.4 | 16 | 0.374 | 9,600 | 11.3 | 1.9 |

| | Dv | Dn | Dv/Dn | Average circularity | Low temperature fixing | Storage stability | Anti-spent | Total evaluation |
|---|---|---|---|---|---|---|---|---|
| Ex. 6 | 6.2 | 5.4 | 1.15 | 0.95 | A | A | II | A |
| Ex. 7 | 5.8 | 4.6 | 1.26 | 0.96 | B | B | II | A |
| Ex. 8 | 5.3 | 4.8 | 1.10 | 0.97 | A | A | III | A |
| Ex. 9 | 5.5 | 4.3 | 1.28 | 0.94 | A | A | II | A |
| Ex. 10 | 5.6 | 4.3 | 1.30 | 0.94 | B | A | II | A |
| Comp. Ex. 4 | 6.5 | 4.8 | 1.35 | 0.94 | C | C | II | C |
| Comp. Ex. 5 | 6.1 | 5.1 | 1.20 | 0.95 | C | A | II | C |
| Ex. 11 | 5.9 | 5.2 | 1.13 | 0.96 | B | B | II | A |
| Ex. 12 | 5.4 | 4.7 | 1.15 | 0.96 | A | A | III | A |

REFERENCE SIGNS LIST

1: image bearing member, or photoconductor
2: toner container
10: developing unit
11: developing sleeve
12, 13: conveyor screw
14: air supply nozzle
16: tube
17: air nozzle pipe
20: air supply tube
21: air pump
22: toner feeding tube
23: toner container
26: powder pump
30: air inflow unit
40: toner container
41: opening portion of toner container
42: bag portion of toner container

The invention claimed is:

1. A toner, comprising:
a binder resin;
a colorant; and
a releasing agent,
wherein:
the binder resin comprises a low molecular weight resin component having a resin softening coefficient (A), represented by formula (1);

$$A=|[\ln G'(r1)-\ln G'(r2)]/(T1-T2)| \quad (1),$$

and has storage elastic modulus (dyne/cm$^2$) G'(Tfb) satisfying $G'(Tfb)\leq 1\times 10^4$ where Tfb is a flow onset temperature (° C.) of the low molecular weight resin component as measured by a capillary rheometer;

$A>0.165$;

T1 is temperature (° C.) at which storage elastic modulus $G'(r1)$ is $1\times 10^5$ (dyne/cm$^2$);

T2 is temperature (° C.) at which storage elastic modulus $G'(r2)$ is $1\times 10^3$ (dyne/cm$^2$) as measured by a viscoelasticity measuring device with measuring frequency of 1 Hz, and measuring distortion of 1 deg; and

|| represents an absolute value.

2. The toner according to claim 1, wherein the low molecular weight resin component is low molecular weight polyester.

3. A two-component developer, comprising:
the toner of claim 2; and
a carrier.

4. The toner according to claim 2, wherein the low molecular weight polyester has a weight average molecular weight of 2,000 to 10,000.

5. The toner according to claim 4, wherein the low molecular weight polyester has an acid value of 1.0 mgKOH to 50.0 mgKOH/g.

6. The toner according to claim 4, wherein the low molecular weight polyester has glass transition temperature of 35° C. to 65° C.

7. The toner according to claim 4, wherein the binder resin further comprises a crystalline polyester resin comprising a polyhydric alcohol and a carboxylic acid.

8. The toner according to claim 2, wherein the low molecular weight polyester has an acid value of 1.0 mgKOH to 50.0 mgKOH/g.

9. The toner according to claim 8, wherein a mass ratio of the low molecular weight polyester to the crystalline polyester, which is represented by (low molecular weight polyester/crystalline polyester), is 1.5 to 2.

10. The toner according to claim 2, wherein the low molecular weight polyester has glass transition temperature of 35° C. to 65° C.

11. The toner according to claim 2, wherein the binder resin further comprises a crystalline polyester resin comprising a polyhydric alcohol and a carboxylic acid.

12. The toner according to claim 11, wherein the crystalline polyester resin comprises an aromatic component in an amount larger than an amount of an aromatic component contained in the low molecular weight polyester.

13. The toner according to claim 12, wherein:

the binder resin satisfies formula (2):

$$1.80 \geq |SP(b)-SP(a)| \geq 1.05 \quad (2);$$

SP($a$) is a solubility parameter (SP) value of the crystalline polyester; and

SP($b$) is a solubility parameter (SP) value of the low molecular weight polyester.

14. The toner according to claim 11, wherein a mass ratio of the low molecular weight polyester to the crystalline polyester, which is represented by (low molecular weight polyester/crystalline polyester), is 1.5 to 2.

15. The toner according to claim 11, wherein:

the binder resin satisfies formula (2):

$$1.80 \geq |SP(b)-SP(a)| \geq 1.05 \quad (2);$$

SP(a) is a solubility parameter (SP) value of the crystalline polyester; and

SP(b) is a solubility parameter (SP) value of the low molecular weight polyester.

16. A two-component developer, comprising:

the toner of claim 1; and a carrier.

17. An image forming apparatus, comprising:

an image bearing member;

an electrostatic image forming unit configured to form an electrostatic image on the image bearing member; and a developing unit configured to develop the electrostatic image with a toner to form a visible image, wherein:

the developing unit is equipped with a toner supplying device, where the toner supplying device comprises:

a toner container housing the toner therein;

an air inflow unit configured to flow air into the toner container;

a pump unit configured to supply the toner as a fluid with the flown air; and a toner feeding tube configured to feed the toner from the toner container to the developing unit;

the toner container comprises:

a flexible member capable of reducing a volume thereof by 60% or greater; and the toner housed in the flexible member, the toner comprises:

a binder resin;

a colorant; and a releasing agent the binder resin comprises a low molecular weight resin component having a resin softening coefficient (A) represented by formula (1):

$$A=|[\ln G'(r1)-\ln G'(r2)](T1-T2)| \quad (1),$$

and has storage elastic modulus (dyne/cm$^2$) G'(Tfb) satisfying $G'(Tfb) \leq 1\times10^4$ where Tfb is a flow onset temperature (° C.) of the low molecular weight resin component as measured by a capillary rheometer;

$A>0.165$;

T1 is temperature (° C.) at which storage elastic modulus G'(r1) is $1\times10^5$ (dyne/cm$^2$);

T2 is temperature (° C.) at which storage elastic modulus G'(r2) is $1\times10^3$ (dyne/cm$^2$) as measured by a viscoelasticity measuring device with measuring frequency of 1 Hz, and measuring distortion of 1 deg; and

|| represents an absolute value.

* * * * *